US005157849A

United States Patent [19]

Ronning

[11] Patent Number: 5,157,849

[45] Date of Patent: Oct. 27, 1992

[54] HIGH DENSITY SINGLE PASS HEAT EXCHANGER FOR DRYING FRAGMENTED MOISTURE-BEARING PRODUCTS

[75] Inventor: Richard L. Ronning, Overland Park, Kans.

[73] Assignee: Ronning Engineering Company, Inc., Overland Park, Kans.

[21] Appl. No.: 770,586

[22] Filed: Oct. 3, 1991

Related U.S. Application Data

[63] Continuation-in-part of Ser. No. 528,812, May 25, 1990, abandoned.

[51] Int. Cl.[5] ..... F26B 11/04

[52] U.S. Cl. ..... 34/135; 34/136

[58] Field of Search ..... 34/135, 136, 137, 140–142, 34/138, 128, 129; 432/105–108, 110, 118, 111, 112

[56] References Cited

U.S. PATENT DOCUMENTS

| | | | |
|---|---|---|---|
| 4,193,208 | 3/1980 | Ronning | 34/136 |
| 4,338,732 | 7/1982 | Coxhill | 34/135 |
| 4,753,019 | 6/1988 | Holopainen | 34/135 |

*Primary Examiner*—Henry A. Bennett

*Attorney, Agent, or Firm*—Hovey, Williams, Timmons & Collins

[57] ABSTRACT

A high density, single pass heat exchanger (26) is provided which is designed for drying products such as bakery wastes, alfalfa, peat moss, wood or similar fibrous products. The exchanger (26) has a series of circumferentially spaced, inwardly directed heat transfer sheet metal flights (48) presenting a central flight-free zone (74), together with a series of baffles (282–288) in axially spaced relationship along the length of the exchanger (26). A number of annular deflectors (294–298) are mounted within the exchanger (26) between adjacent baffles (282–288), such that the baffles (282–288) and associated deflectors (294–298) cooperate to cause the material being dried to follow an essentially serpentine, generally helical path (300). The exchanger (26) is capable of efficiently removing moisture from wet products by virtue of the fact that the diameter (R) of the exchanger (26) to the diameter (r) of the internal flight-free central zone (74) is from about 1.4–2.4. The disclosed exchanger design may be used for updating existing three-pass and single-pass dryers, or for the fabrication of new systems.

50 Claims, 10 Drawing Sheets

HIGH DENSITY SINGLE PASS HEAT EXCHANGER FOR DRYING FRAGMENTED MOISTURE-BEARING PRODUCTS

This is a continuation-in-part application of Ser. No. 07/528,812, filed May 25, 1990.

BACKGROUND OF THE INVENTION

1. Field of the Invention

This invention relates to high density, single pass heat exchangers especially useful for drying fragmented moisture-bearing products such as fibrous materials in the nature of bakery wastes, alfalfa, peat moss and wood products.

2. Description of the Prior Art

Drying of large volumes of fragmented fibrous materials has long been carried out in heat exchangers consisting of one or more elongated, generally horizontally oriented drums. Hot gases are caused to flow through each to remove moisture from the material by heat exchange between the hot gases and the fibrous product. Generally speaking, a burner is disposed to direct hot products of combustion directly into the inlet of the drum which also receives the moisture-bearing material to be dried. After removal of the requisite amount of moisture from the material, it is directed into a collector or other receiving means at the outlet of the heat exchange drum. Oftentimes, a blower or equivalent device is associated with the drum to increase the rate of flow of hot gases through the exchanger.

Alfalfa, for example, has long been dried in horizontally positioned heat exchange drums which typically have been from about 8 to approximately 12 feet in diameter and 20 to 40 feet long. As each drum was rotated about its longitudinal axis, hot burner gases were directed into the inlet and airflow was increased by a blower connected to the outlet of the drum. Initially, single pass drums were the dryer of choice principally because of economic considerations. The manufacturing cost of the dryer was a more important overall consideration on an amortized basis than the amount of fuel burned because of relatively low natural gas prices. For many years, the alfalfa dehydration industry advertised that dehydrated alfalfa was a superior product because it was produced from alfalfa that was supplied to the dehydrated plant substantially at fresh cut moisture levels with water then evaporated from the product to its final desired dry level of no more than about 8 to 10%.

Even during the era of relatively low fuel prices, single pass evaporators in the alfalfa dehydration industry were supplanted in many instances by so-called three-pass dryers which permitted processing of higher volumes of the ground alfalfa in essentially the same overall ground space occupied by then existing single pass heat exchangers. In three-pass dryers, material was directed along a generally S-shaped path of travel thereby providing a longer path and shorter residence time in the dryer by virtue of increased hot gases velocities.

Single pass dryers have previously been employed having inwardly directed internal flighting in the drum which caused the material conveyed through the dryer to be lifted up somewhat and dropped back into the hot gas stream rather than simply resting at the bottom of the drum as it was rotated about its axis. An exemplary design in this respect is disclosed in applicant's U.S. Pat. No. 4,183,208 which incorporated secondary flighting in the central part of the drum for the purpose of enhancing heat exchange between the hot gases directed through the drum and the product to be dried.

In order to prevent hot gases from being blown directly through the drum from one end to the other, single pass dryer designers in the past have resorted to the use of a transverse plate or plates in the drum to obstruct the flow of hot products of combustion. The net result of such construction inevitably was to decrease the capacity of the dryer while at the same time interfering with uniform temperature control and preventing maintenance of constant material flow rates through the heat exchanger.

Three-pass dryers, on the other hand, were more expensive than single pass dryers but found favor because of the decreased product residence time necessary to assure adequate drying and more stable temperature control performance.

As fuel prices have risen, dehydration plant operators for example have become increasingly more concerned about fuel costs and have significantly retreated from a position that alfalfa should be introduced into the dryer at fresh cut moisture levels approaching 85%. More and more reliance has been placed on sun curing with the alfalfa introduced into a dryer being no higher than about 35 to 75% moisture. Significantly higher fuel costs have resulted in a substantial retrenchment in the alfalfa dehydration business with less efficient plants being closed down rather than updated.

As plants have closed, those still in business have sought ways to rehabilitate their equipment by increasing efficiency so that the facilities will accommodate greater and greater demand in order to permit continuing operation. New plants also require that a highly efficient process be provided to effectively compete when the overall costs of building a totally new plant are factored into the equation.

The rotary kiln illustrated a described in U.S. Pat. No. 4,753,019 and which was designed to dry calcium carbonate sludge, would not be useful to remove moisture from a material such as alfalfa or the like. The '819 patent mixing rods within the drum would not provide adequate agitation of the material to be dried, and especially would not function to lift the material and provide a shower thereof which falls through the hot drying gases.

The asphalt dryer of U.S. Pat. No. 4,338,732 has internal flighting for lifting of the product, but does not have adequate means to assure turbulent flow of hot gases through a product such as alfalfa, and there would be inadequate residence time of the fragmented material in the drum to reduce the moisture content of alfalfa or a similar product to a required level.

SUMMARY OF THE INVENTION

This invention relates to a high density, single pass heat exchanger for drying fragmented, moisture-bearing products which is especially adapted for either updating existing three-pass and single pass dyers or for fabrication of highly efficient new plants. This goal is accomplished by providing a generally horizontal hollow drum heat exchanger which has a series of novel, circumferentially spaced, inwardly directed, product conveying, showering conductive and convective heat transfer flights extending inwardly toward the center of the drum where the total surface area of the flights is at least about as large as the total heat transfer surfaces of the products to be dried which are flowing through the heat exchanger at its maximum rated product throughput capacity.

The single pass dryer therefore has flights which extend inwardly into the interior of the drum to a greater degree than in past single pass dryers of this type while still leaving a flight-free central showering zone of a size allowing adequate heat exchange and conveyance of material along the length of the dryer at a predetermined rate. The unexpected ability of the heat exchanger to efficiently remove moisture from fragmented products such as alfalfa, bakery wastes, peat moss and wood materials is in part attributable to the unique relationship of the diameter of the drum to the diameter of the internal cylindrical flight-free central showering and product conveyance zone such that the diameter (R) of the drum divided by the diameter of the zone (r) yields an aspect ratio (R/r) within the range of about 1.4 to 2.4. This critical relationship has been found to be important in assuring maximum heat exchange without deleterious effects on the product being dried.

A series of transversely oriented, axially spaced, circular discs or baffles and associated rings are mounted in the drum in order to cause the material being dried and the hot products of combustion introduced into the dryer to follow an essentially serpentine, generally helical path longitudinally of the drum. These baffles are of increasing diameter as the outlet end of the drum is approached. They are of dimensions such that the peripheral edges thereof do not overlap with the inner margins of the internal flighting mounted within the drum.

The drum flights are made up of a series of metal panel or sheet members which extend longitudinally of the drum and also project into the interior of the cylinder. The individual flights comprise a series of members which in sequence around the circumference of the drum are made up of straight, radially extending members on each side of a transversely bent or dog-legged sheet member oriented to enhance transfer of the fragmented product to the top of the drum for gravitational fall through the flight-free zone in a showering pattern that results in substantially uniform dispersion or distribution of the product being dried throughout the extent of the showering and conveyance zone.

Improved results have also been obtained by dividing the drum flights into a number of different sections extending longitudinally of the heat exchange drum with adjacent flight sections in effect being rotated with respect to one another during fabrication so that the angular flight members of each section act somewhat differently on the product being dried as it is conveyed through respective flight sections. This enhances moisture removal and at the same time assures uniform conveyance of the material along the length of the dryer. An important feature of the present invention is the fact that the novel flight defining structure hereof may be directly substituted for the interior components of a three-pass dryer without significant alteration of the dryer drum itself. At the same time, significantly higher product throughput capacity is realized to meet the same dried product specifications.

DETAILED DESCRIPTION OF A FIRST EMBODIMENT OF THE INVENTION

Figure 1:
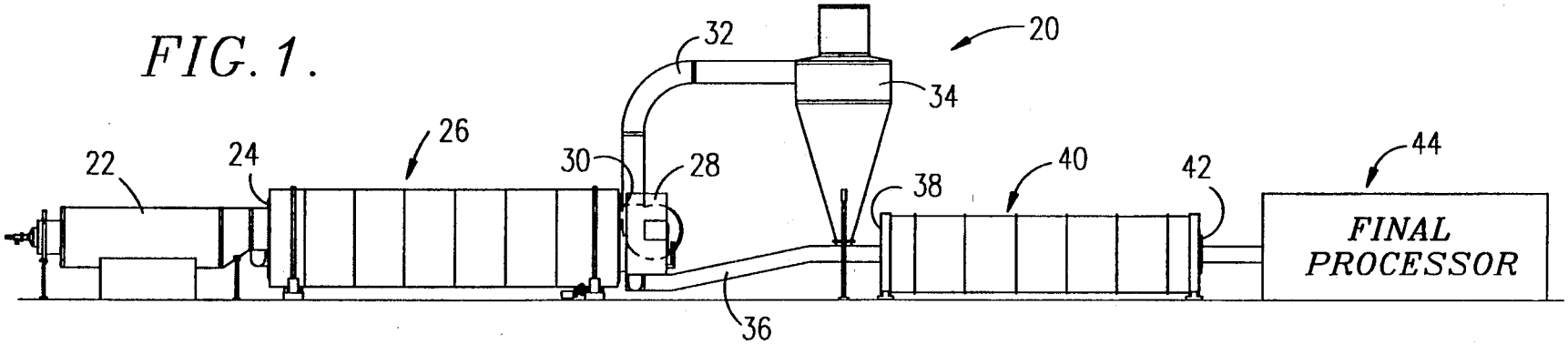
FIG. 1 is a side elevational view of a typical dehydration plant for removing moisture from various types of fibrous products such as alfalfa, bakery wastes, peat moss and wood materials, illustrating from left to right, the burner assembly, the drum heat exchanger of this invention, a centrifugal discharge and primary fan, the primary collector, a cooling and conditioning drum, and a final processor.

FIG. 1 is an overall essentially schematic representation of a single pass dehydration system 20 for evaporating water from a fragmented moisture-bearing product such as bakery wastes, alfalfa, peat moss, wood materials, or similar products. The system shown is of the type which is especially useful for dehydration of chopped alfalfa.

Although system 20 is particularly adapted for drying of chopped alfalfa or similar agricultural products, it is to be appreciated that such system has a wide variety of uses in instances where it is desirable to lower the moisture content of a fragmented product to about 10%–15% levels. In the case of alfalfa, the fibrous material is chopped to cause the fibers to be no more than about 3 inches in length. In other instances, the product can be more finely divided than is the case with alfalfa to present a larger surface area for contact between the hot burner gases and the material undergoing drying in system 20. Oftentimes, the fragmented, moist material is in the form of small particles having an effective diameter of no more than about 1/16 inch. Wood materials fall into this category with sawdust being an exemplary product which benefits from drying before transportation and use thereof. Dried sawdust has been used extensively for energy purposes by burning the sawdust to produce heat, and then using that heat to generate steam for power generation and similar applications. Bakery wastes, on the other hand, are dried in order to permit their subsequent use as animal feeds and the like. Peat moss is frequently dried prior to shipment to points of use in order to reduce transportation costs calculated on a weight per mile basis. Other moisture-bearing fibrous products in fragmented form are candidates for drying using the improved heat exchanger of this invention.

System 20 typically includes a burner assembly 22 adapted to burn natural gas or a similar feed stock to produce hot products of combustion which are directed into the inlet end 24 of an elongated, generally horizontal, hollow drum heat exchanger broadly designated 26 which is rotatable about its longitudinal axis. A centrifugal discharge and fan unit 28 is connected to the outlet end 30 of drum 26. Conduit 32 connects the blower unit 28 to the upper end of a conventional primary cyclone collector 34. The lower extremity of the collector 34 connects to a conveyor conduit 36 which leads from the bottom of centrifugal discharge and blower unit 28 to the inlet end 38 of a cooling and conditioning drum 40 which is also rotatable about its axis. Outlet end 42 of drum 40 is joined to a final processor 44 where cubing, packaging or storage of the dried product may be carried out.

As is best depicted in FIGS. 2–5 inclusive, heat exchange drum 26 has a cylindrical shell 46 which typically is from 8 to 14 feet in diameter, and some 24 to 140 feet long. A series of circumferentially spaced, inwardly directed, product-conveying, showering and both convective and conductive heat transfer flights generally designated 48 are mounted within shell 26 for agitating the fragmented product to be dried, lifting the product to the top of the drum for free-fall in the interior space thereof, and to disperse the product over the central showering zone for most effective heat transfer and pneumatic selective conveying between the hot gases from the burner 22 and the moisture-laden, fragmented product to be dried.

Figure 5:
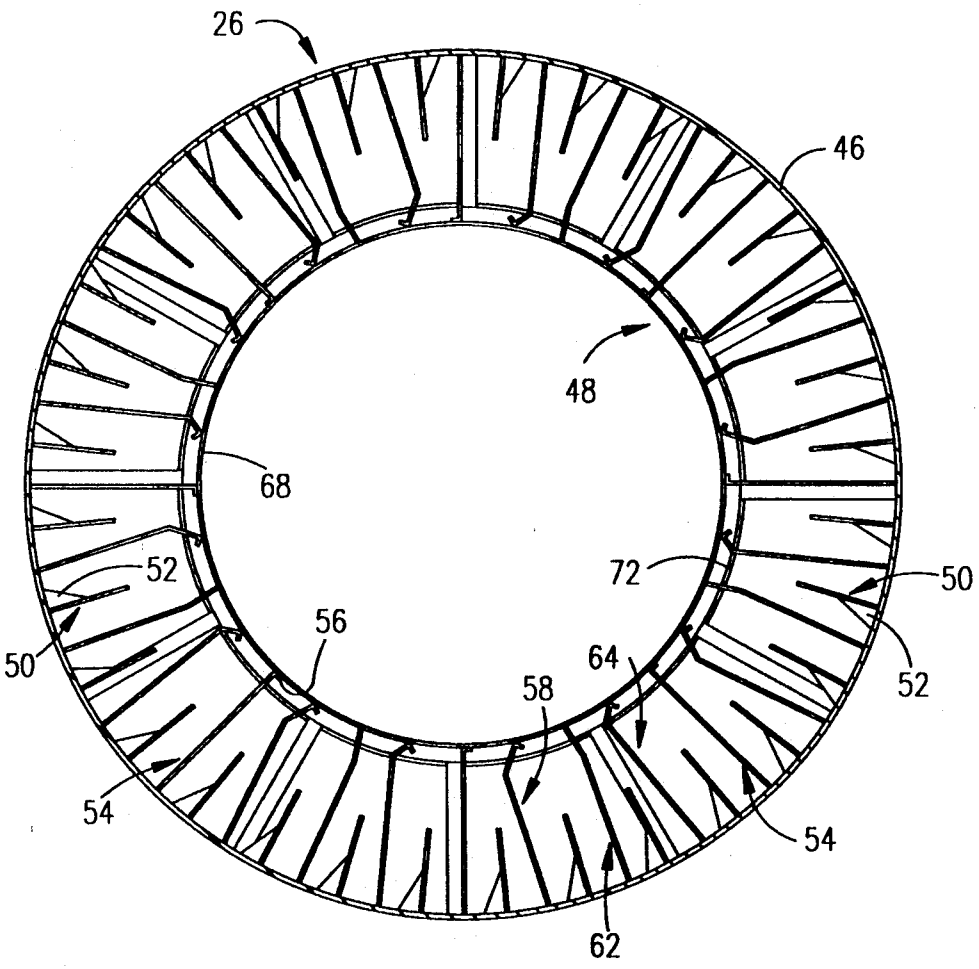
FIG. 5 is a vertical cross-sectional view taken along the line 5—5 of FIG. 4.
Figure 6:
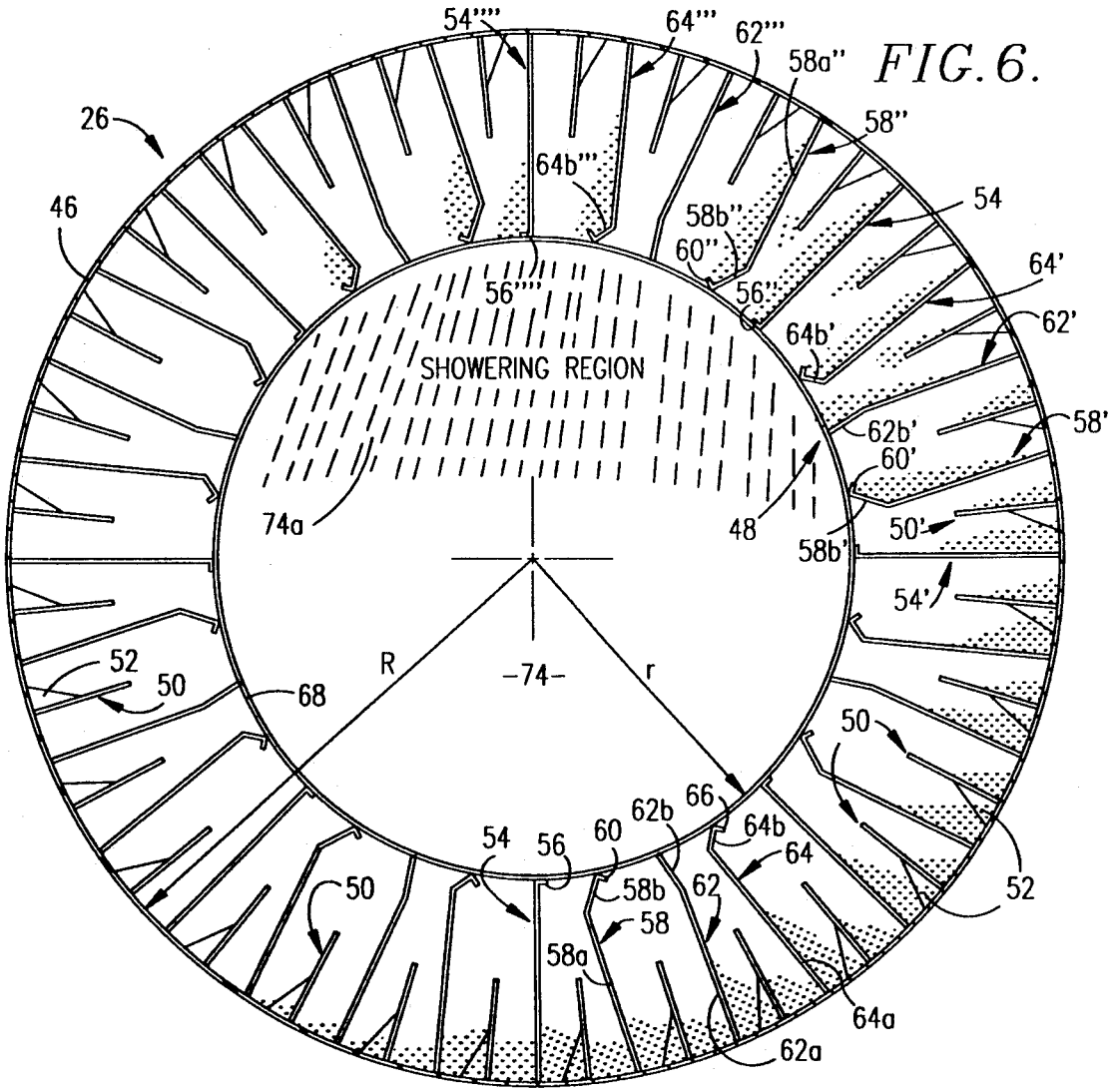
FIG. 6 is an enlarged, essentially schematic vertical cross-sectional view similar to FIGS. 3 and 5, illustrating the relationship of the diameter of the drum to the diameter of the flight-free zone in the interior thereof, showing the product showering and conveying region defined by such zone, and also depicting the three different types of dog-leg shaped sheet members making up the flighting.

As perhaps best shown in the schematic representation of FIG. 6, the flights 48 are made up of a number of sheet metal members which project into the interior of drum 26 from the interior surface of shell 46, and also extend longitudinally of drum 26. In the preferred structure of the first embodiment of the invention shown in FIGS. 1–7 inclusive and FIGS. 9 and 10, flights 48 have a series of transversely and longitudinally straight, relatively narrow width metal sheet members or panels 50 connected to the inner surface of shell 46 and located in radial disposition with respect to the axis of shell 46. Triangular metal support gussets 52 are also welded to the inner surface of shell 46 and to the trailing surface of each of the metal sheet members 50, viewing FIGS. 3, 5 and 6, stabilize each of the members 50. In an exemplary installation, three of the gussets are provided for each 48 inch long sheet member 50. The gussets 52 thereby support a respective sheet metal member 50 and prevent dislodgement of such members 50 from their desired position and prevent significant adverse warpage from occurring by virtue of contact with the hot gases emitted by burner assembly 22.

A plurality of radially oriented sheet metal members 54 are provided to the right of each narrow width metal sheet member 50 in a counterclockwise direction viewing FIG. 6. The members 54 project into the interior shell 46 to a substantially greater degree than an adjacent member 50. Members 54 also extend longitudinally of the drum 46 in generally parallel relationship to respective shorter members 50. An out-turned leg segment 56 integral with the innermost extremities of each sheet member 54 and extending the full length thereof, is at an angle of about 90° with respect to the main body of a respective sheet metal member 54. As is apparent from FIGS. 3, 5 and 6, the out-turned leg segments 56 are comparatively short in a direction perpendicular to the main body of a respective sheet metal member 54. For example, where the radial width of the member 54 is about 24 inches, the return 56 would typically be about 1 to 1½ inches.

To the right of each member 54 in a counter-clockwise direction is another relatively short flight member 50 supported by a series of gussets 52.

The next sheet flight member of maximum radial width to the right of each straight sheet metal member 54 is a dog-leg sheet member 58 which has a relatively long inwardly directed leg segment 58*a* which is connected directly to the innermost surface of the shell 46, and an inner, shorter leg segment 58*b*. A return leg segment 60 provided at the innermost end of each dog-leg member 58, projects the same direction as the segment 56 on an adjacent member 54. The leg segment 58*b* of each dog-leg member 58 is bent in the same direction as the return leg segment 60 to present an obtuse angle between leg segments 58*a* and 58*b*. It is also to be observed from FIG. 6 that the leg segment 58*a* of each dog-leg member 58 is at an angle with respect to a radial line between the center of shell 46 and the point of attachment of a respective leg segment 58*a* with shell 46. In the case of a 10 foot diameter drum 26, it is preferred that each of the segments 58*a* be at an angle of about 7° with respect to a radial line through such flight member and that the obtuse angle between segments 58*a* and 58*b* be approximately 143°. In that manner, the leg segment 58*b* is at an angle of +25° with respect to the radial line. (The +° designation in this respect is intended to mean that the leg segment 58*b* is bent to the right viewing FIG. 6.)

To the right circumferentially of each dog-leg member 58 as shown in FIG. 6, is another relatively narrow radially extending sheet member 50 supported by corresponding gussets 52.

As if further apparent from FIG. 6, to the right in a counterclockwise direction from each of the dog-leg members 58 is a dog-leg flight member 62. The larger leg segment 62*a* of each dog-leg member 62 is joined to the inner surface of shell 46 while the innermost leg segments 62*b* thereof are bent in the opposite direction from leg segments 58*b* of dog-leg members 58 to present what may be considered a minus angle with respect to a radial line between the center of the shell 46 and the point of connection of each dog-leg member 62 to shell 46. In a preferred embodiment, the angle of each segment 62*a* with respect to corresponding radial lines is about 4°, the obtuse angle between leg segments 62 and 62*b* is about 161° and the angle of segment 62*b* relative to a respective radial line is about −15°. The dog-leg member 62 in a preferred embodiment as illustrated do not have innermost leg segment returns such as segment 60 of member 58 and segment 56 of member 54.

Another relatively narrow planar sheet member 50 is provided to the right of each dog-leg member 62 viewed in a counterclockwise direction which in turn are supported by corresponding triangular gussets 52.

The next flight member to the right of each dog-leg member 62 beyond a respective member 50 therebetween as shown in FIG. 6 is a dog-leg member designated by the numeral 64. Each dog-leg member 64 has a large outer leg segment 64*a* and a much smaller innermost bent leg segment 64*b*. A return segment 66 is provided on the outermost extremity of each leg segment 64*b* at 90° with respect thereto and of the same dimensions as segments 56 and 60. The leg segments 64*a* of dog-leg members 64, joined to the inner surface of shell 46, are preferably at an angle of about 3.5° with respect to a radial line between the center of shell 46 and the point of connection of a corresponding leg segment 64*a* to shell 46. The obtuse angle between segment 64*a* and segment 64*b* of each flight member 64 is preferably about 131.5° whereby the leg segments 64*b* are each at an angle of about 45° relative to respective radial lines.

Another relatively narrow, gusset-supported sheet metal member 50 secured to the innermost surface of shell 46 is provided between each adjacent pair of flight members 64 and 54.

Figure 2:
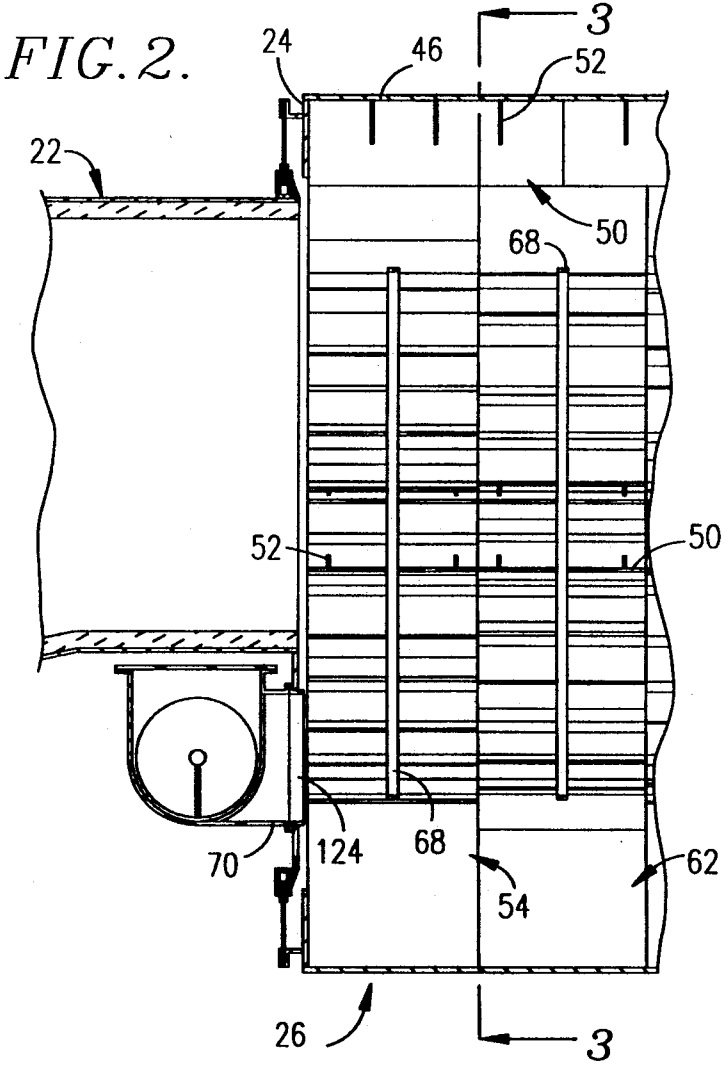
FIG. 2 is an enlarged fragmentary, vertical cross-sectional view at the inlet end of one embodiment of a drum heat exchanger embodying the present invention.
Figure 4:
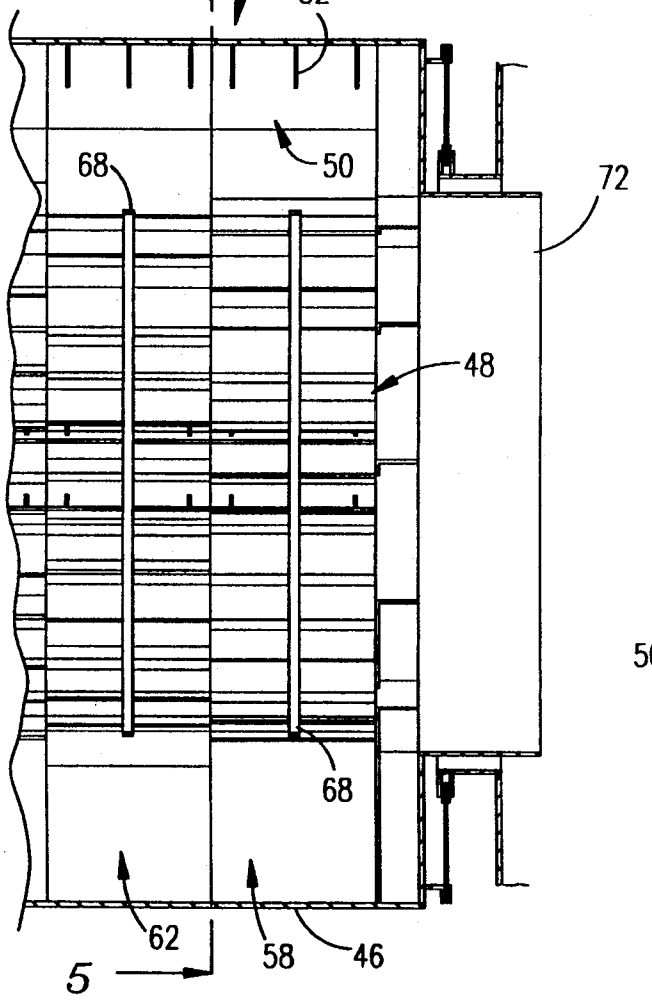
FIG. 4 is an enlarged fragmentary, vertical cross-sectional view at the outlet end of the embodiment of the drum heat exchanger shown in FIGS. 2 and 3.

Viewing FIGS. 2 and 4, it can be seen that a series of ring elements 68 arranged longitudinally of drum 26 are joined to the outer extremities of flight members 54, 58, 62 and 64 for maintaining the circumferential spacing between the inner ends of such members. It is to be preferred that one or more support ring element be provided for each individual sheet member to which they are joined, along the length of the shell 46. Normally, the ring elements 68 are located intermediate the ends of each discrete flight member. All of the sheet metal members are connected to the inner surface of shell 46 in equidistantly spaced relationship. In like manner, the areas of connection where extended sheet metal members 54, 58, 62 and 64 are joined to respective ring elements 68 are in disposition such that the points of securement of the sheet metal members to the ring elements are equidistantly space.

In view of the fact that the heat exchanger drum 26 is normally of significantly greater length and diameter, e.g., 24 to 140 feet in length as compared with 8 to 14 feet in diameter, for fabrication purposes and because of the tendency of such sheet members to buckle at the temperatures present inside of the dryer drum during normal operation, if the members are excessively long, it is to be preferred that each sheet member be made up of a number of sections along the length of the shell 46. In typical installations, the length of each individual sheet member longitudinally of the drum 26 may be anywhere from about 30 inches to about 48 inches.

Another advantage of breaking each sheet member into a number of sections along the length of the drum is the fact that it is possible to provide a dryer wherein at least certain of the sheet metal members are of different transverse angularities and shapes along the length of the drum, although still longitudinally aligned. This can be accomplished either during fabrication of a new heat exchanger drum 26, or at the time of rehabilitation of an existing three-pass dryer to convert it into a single pass drum. All of the flight members of a particular section may in effect be rotated a certain number of degrees relative to an adjacent section of flight members, or only those wider flight members that project inwardly sufficiently that they are supported at their inner ends by ring elements 68 may be shifted circumferentially of the drum to enhance the drying efficiency of the process, alter the flow pattern of moisture-bearing products along the length of the dryer, vary residence time, or provide compensation for the type of material to be dried. The narrower sheet members 50 which have gusset supports 52 need not be of the same longitudinal length as adjacent wider sheet metal flight members, even though the wider members are not of the same angularity or shape throughout the longitudinal length of a drum installation, because the narrower flight members 50 have essentially the same effect on the material throughout the drying process and there is no need to rotate the positions thereof circumferentially of the drum along the length of the shell 46. For this reason, the narrower sheet metal members 50 are generally fabricated to be longer than adjacent sheet metal flight members 54, 58, 62 and 64 for efficiency of installation and minimization of parts. It is to be understood though that if desired, the longitudinal length of all of the flight members of discrete circumferentially extending, longitudinally aligned, end-to-end sections of the drum heat exchanger may be of the same length. Because of the fact that the flight members are all spaced such that the points of attachment thereof to shell 46 are equidistant from one another, while the points of attachment of members 54, 58, 62 and 64 to respective ring elements 68 are also equidistant, it is to be appreciated that upon rotation of the wider flight members circumferentially of the drum from section to section, the degree of shifting should be equal to the spacing between adjacent flight members so that longitudinal alignment is maintained throughout the length of the heat exchanger shell 46.

Figure 9:
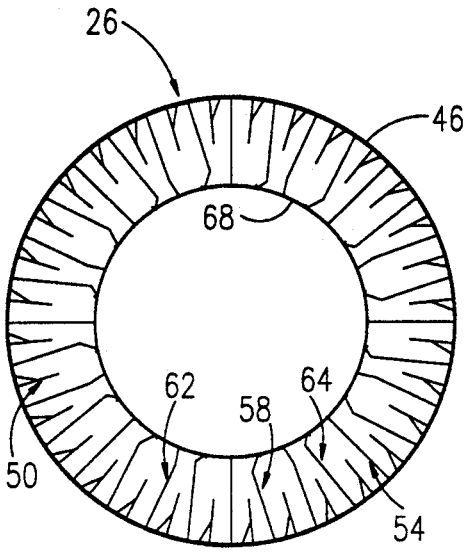
FIG. 9 is a schematic, vertical cross-sectional representation on a reduced scale of the dryer drum of FIGS. 1–7 or 8.
Figure 10:
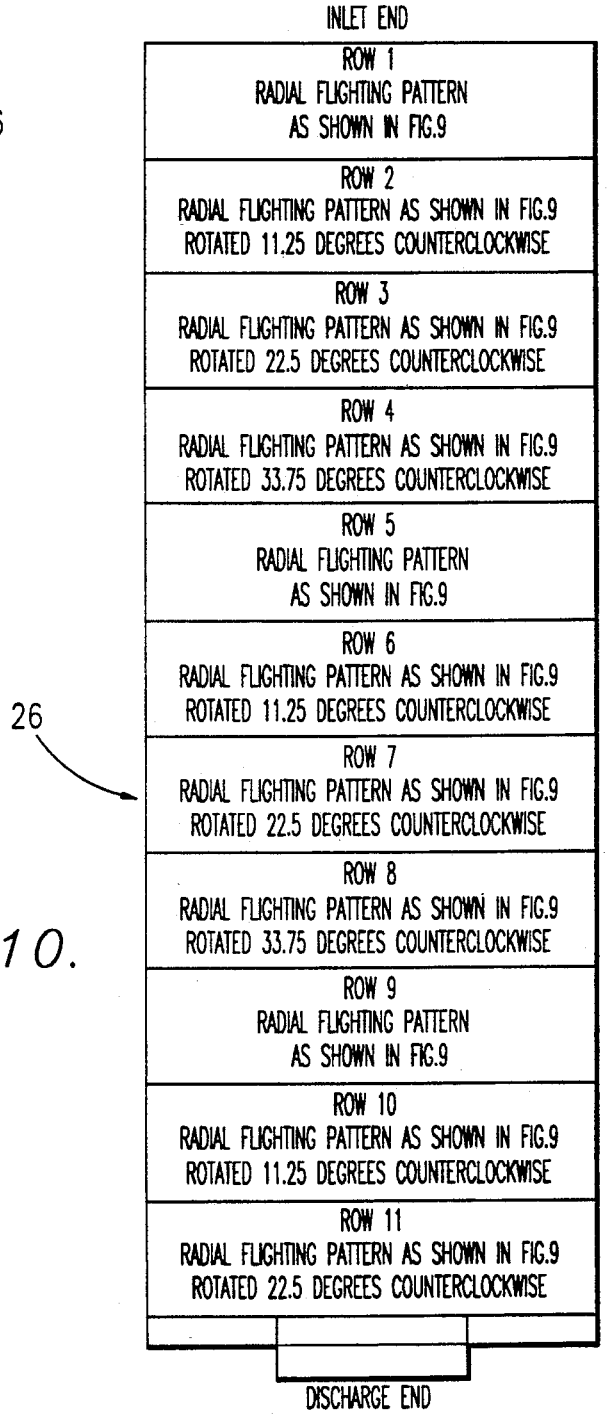
FIG. 10 is a schematic representation of the heat exchanger of FIGS. 1–9 and indicating the degree of rotation of the flight sections one with respect to the other along the length of the heat exchanger.

Thus, as is apparent from the schematic representation of FIG. 10 which illustrates schematically a dryer drum 26 as shown in FIGS. 1–7 and 9 respectively, having an internal diameter of about 10 feet with a shell thickness of about ¼ inch, and a length of approximately 30 feet, the flights are desirably divided up into eleven separate circumferentially extending rows in end-to-end relationship within the drum. In row 1, the radial flighting pattern may be as schematically depicted in FIG. 9. Under these circumstances, and assuming that the radius (R) of the drum 26 divided by the radius (r) of the elements 68, the aspect ratio (R/r) of the dryer is about 1.63.

With that aspect ratio, row 2 of the flight members as shown in FIG. 9 if the wider flight members attached at their inner ends to support rings 68 are rotated counterclockwise at the time of installation so as to stay in alignment with the first row of wider flight elements, then the second row of wider members will have been rotated or shifted 11.25° counterclockwise. Similarly, the flight sections along the length of the dryer drum 26 from the inlet end 24 to the outlet end 30 thereof will have been during installation to the extent set out in FIG. 10.

Figure 7:
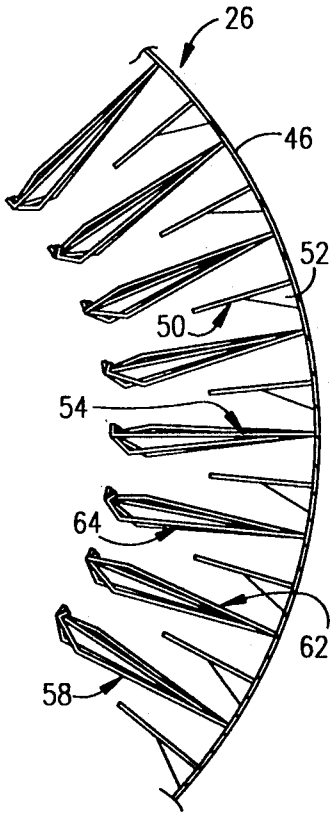
FIG. 7 is a fragmentary, vertical cross-sectional view through the drum of FIGS. 2–6 and illustrating the way in which the flight sections installation patterns are rotated relatively along the length of the drum for more efficient moisture removal and conveyance of product through the drum.

Thus, in order to maintain the wider flight members in longitudinal alignment throughout the length of the shell 46 as is best shown by FIG. 7, circumferential row 1 of flight members if in the pattern as shown in FIG. 9 would result in the wider members of row 2 being rotated 11.25° counterclockwise, the wider members of row 3 rotated 22.5° counterclockwise as compared with row 1, the wider members of row 4 rotated 33.75° counterclockwise with respect to row 1, row 5 having the same flighting pattern as that of row 1, the wider members of row 6 again rotated 11.25° counterclockwise from the pattern of row 1, the wider members of row 7 rotated 22.5° counterclockwise as compared with row 1, the wider members of row 8 rotated 33.75° counterclockwise from the row 1 pattern, row 9 disposed in the same radial pattern as row 1, the wider members of row 10 rotated 11.25° counterclockwise from row 1, and the wider members of row 11 rotated 22.5° counterclockwise as compared with row 1.

In the embodiment represented by FIG. 10, wherein the drum has a cross-sectional diameter of about 10 feet, 4 inches and a length of about 30 feet, a preferred construction has wider flight members 54, 58, 62 and 64, 32 inches in length and about 24 inches in width measured from the inner surface of shell 46 to the internal diameter of ring elements 68. The narrow flight members 50 on the other hand are each typically 48 inches long and 12 inches in width, with the members at the ends of the dryer being of less length if necessary depending upon the overall length of the drum.

Figure 8:
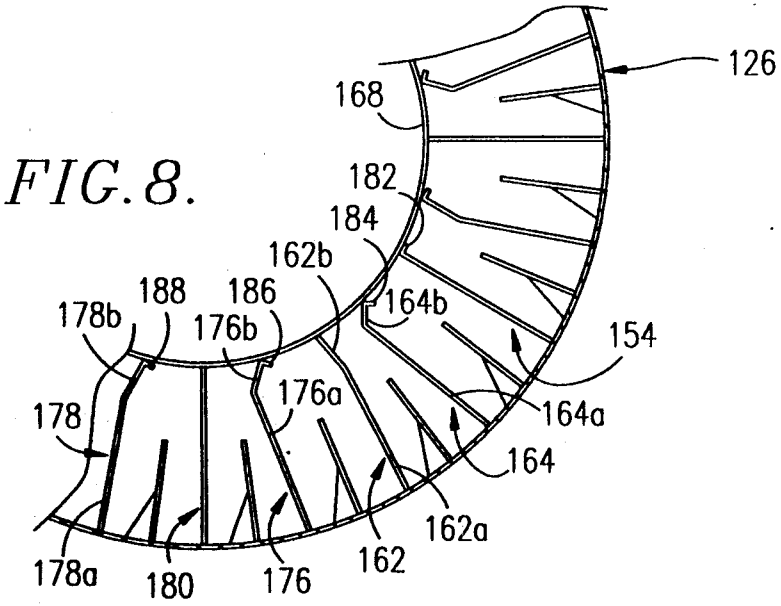
FIG. 8 is a fragmentary, vertical cross-sectional view of an alternative embodiment of the drum illustrated in FIGS. 2–7 inclusive wherein the radially oriented flat sheet members making up the flighting within the dryer do not have out-turned innermost edges as is the case with the embodiment of FIGS. 1–7 and four different types of dog-leg shaped flight sheet members are provided.
Figure 11:
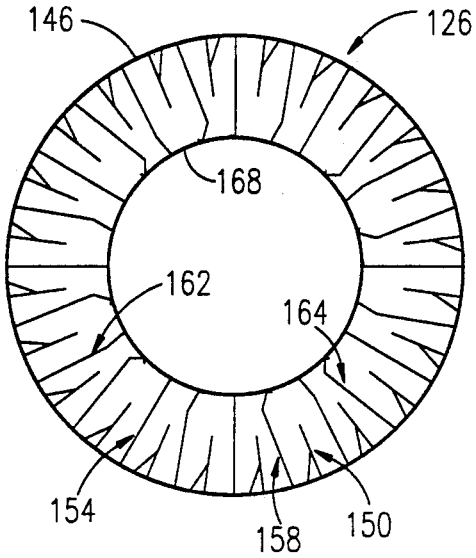
FIG. 11 is a schematic, vertical cross-sectional representation on a reduced scale of another embodiment of the drum heat exchanger.
Figure 12:
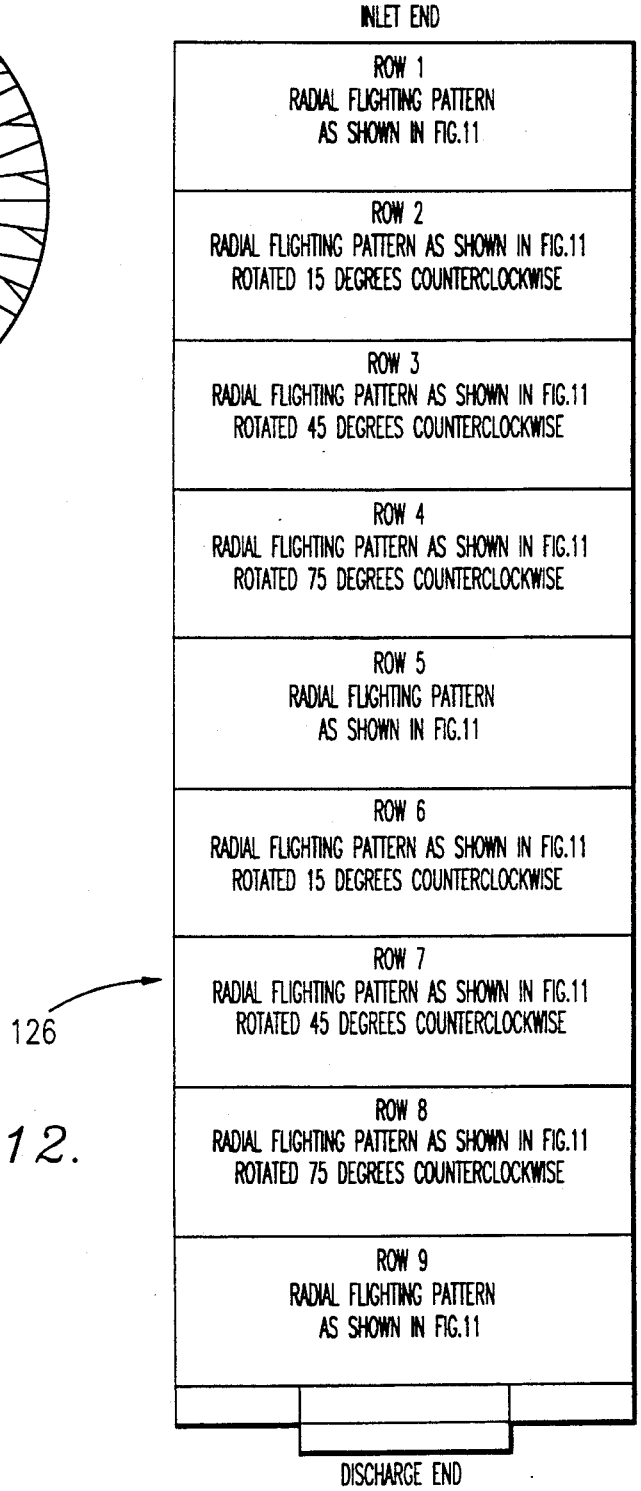
FIG. 12 is a schematic representation similar to FIG. 10 but in this case illustrating the degree of rotation of the flight sections one with respect to the other of a drum embodying flight section structure as illustrated in the alternate embodiment as shown in FIGS. 8 and 11.

In like manner, the heat exchanger drum 126 of the alternative embodiment shown in FIGS. 8, 11 and 12, having a diameter of about 8 feet and a length of approximately 24 feet, may for example have ring elements 168 which are about 54 inches in diameter. Under these circumstances, the wider members 154, 162, 164, 176, 178 and 180 may be about 21 inches in width while narrow members 150 can in the example give be about 12 inches in width. In this type of installation, the wide flight members 154, 162, 164, 176, 178 and 180 are all 31 inches in length while the narrow members 150 are typically 48 inches in length except for end members which are of necessary length, as for example, about 36 inches, again depending on the length of the overall dryer.

As is apparent from the schematic representation of FIG. 10., a rehabbed three-pass dryer which is 8 feet in diameter and from 24 to 25 feet long would normally be divided up into nine rows or sections of flights with the flight pattern of the first row being as shown in FIG. 11. The wide flight members 154, 158, 162 and 164 in row 2 are thereby rotated 15° counterclockwise with respect to the same wider flight members of row 1. The wider members of row 3 are rotated counterclockwise 45° with respect to the pattern of row 1, the wider members of row 4 rotated 75° counterclockwise relative to row 1, the radial flighting pattern of row 5 are the same as row 1, the wider members of row 6 are rotated 15° counterclockwise with respect to rows 1 and 5, the wider flight members of row 7 are rotated 45° counterclockwise with respect to rows 1 and 5, the wider flight members of row 8 are rotated 75° counterclockwise relative to rows 1 and 5, and the wider flight members of row 9 are again the same pattern as rows 1 and 5.

In the eight foot diameter embodiment of FIGS. 8, 11 and 12, where the drum shell 146 radius (R) is about 4 feet and the radius (r) of the ring elements 68 is about 27 inches, the aspect ratio (R/r) is approximately 1.77. The dog-leg shaped flight members 176 are constructed such that the wider legs **176*a* are at an angle of about 6.25° transversely of the shell 146 with respect to radial lines extending from the center of the drum to the point of attachment of respective legs 176*a* to the inner surface of shell 146. The innermost narrow leg segments 176*b* are in positions presenting an obtuse angle between corresponding leg segments 176*a* and 176*b* of about 143.75°. This causes the innermost narrow leg segments 176*b*** to be at an angle of about +30° with respect to the associated radial lines.

Dog-leg shaped flight members 162 of each row or section of flights are positioned such that the outer wider leg segments **162*a* are at an angle of about 5° with respect to corresponding radial lines through the center of the drum and the point of attachment of respective leg segments 162*a* to the shell 146. The obtuse angle between the outer wide leg segments 162*a* of members 162 and the inner leg segments 162*b* thereof is about 160° with the leg segments 162*b*** being oriented in directions such that the leg segments are at an angle of about −15° with respect to corresponding radial lines.

The flight members 164 have outer wide leg segments **164*a* positioned such that they are at an angle of about 7° with respect to the corresponding radial lines extending between the center of drum shell 146 and points of attachment of leg segments 164*a* to shell 146. An obtuse angle of about 128° is presented between the innermost leg segments 164*b* of dog-leg shaped members 164 and the outer wider leg segments 164*a*. In this manner, the inner leg segments 164** are at an angle of about +45° with respect to corresponding radial lines.

The dog-leg shaped flight members 178 are disposed such that the outer leg segments **178*a* thereof are at an angle of about 5° with respect to a corresponding radial line, while the outer leg segments 178*b* of each member 178 present an obtuse angle relative to a respective leg segment 178*a* of about 160°. Thus, the leg segments 178*b*** are each at an angle of about +15° with respect to the associated radial lines.

It is to be observed from FIG. 8 that the wide straight members 154 have short innermost 90° returns 182 thereon, but that wide straight members 180 do not have such returns. This is in contrast with the embodiment of FIGS. 1–7 and 9–10 wherein all of the wide straight members 54 are provided with returns 56.

The innermost leg segments **164*b* of wide members 164, short leg segments 176*b* of wide members 176 and short leg segments 178*b* of wide members 178 also have narrow 90° returns 184, 186 and 188 respectively thereon turned to the right as shown in FIG. 8, as are the returns 182 on members 154. The return leg segments 182, 184, 186 and 188** are also about 1 to 1½ inches in width.

Figure 3:
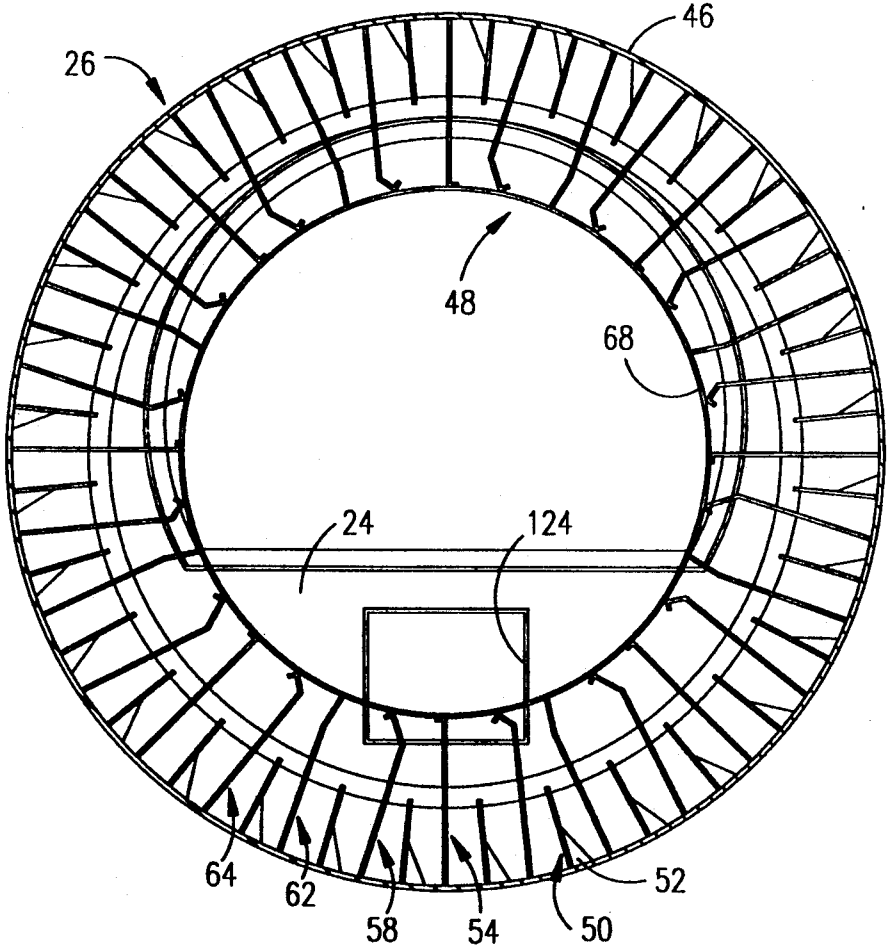
FIG. 3 is a vertical cross-sectional view taken along the line 3—3 of FIG. 2 and looking in the direction of the arrows.

As is most evident from FIGS. 2 and 3, material to be dried is introduced into the drum 26 via inlet opening 124 which communicates with an inlet conduit 70. Similarly, as depicted in FIGS. 4 and 5, material exits drum 26 via outlet extension 72 connected to the centrifugal discharge and blower assembly 28.

During rotation of the drum 26 as shown in FIG. 6, at a speed of from about 4 to about 10 r.p.m., material to be dried is elevated by the various flight members until such material may fall by gravity toward the inner part of the individual flight members. In the case of the narrower members 150, moisture-bearing fragmented product lifted by the narrow members 150 eventually slides off onto the immediately underlying wider flight member 54, 58, 62 or 64. The angularity, and width of the inner leg segments of respective members **58*b*, 62*b* and 64*b*, as well as the leg return segments 56 of straight members 54, return segments 60 of dog-leg members 58, and return segments 66 of dog-leg members 64 retard release of the fragmented material to be dried into the product showering region or zone 74 in a manner such that in conjunction with the combination of momentum and centrifugal forces present, there is relatively uniform dispersion of the material throughout the full circular area of the zone 74**.

As depicted in FIG. 6, assuming that the depiction represents the drum rotating in a counterclockwise direction but frozen in time for purposes of illustration, it can be seen that the straight member 54' located at a 3:00 position is in disposition such that there is little tendency for material supported by the flight member 54' at that location to allow material to gravitate into the interior showering zone 74. However, the narrow flight member 50' immediately thereabove is slightly inclined so that there will be some flow of product off the end of the flight member down onto the underlying straight flight member 54'.

Continuing with the frozen in time sequence, the dog-leg flight member 58' immediately above narrow flight member 50' is receiving material from the flight member 50' directly thereabove but the upwardly bent leg segment **58*b*' of such flight member, and the return segment 60' thereon prevents significant delivery of fragmented product into the showering zone unless there is sufficient material to overflow the flight member 58'** which defines somewhat of a channel shape when disposed in that position during its rotation.

The flight member 62' directly above flight member 58' is located in a position of about 2:30 whereby its outer leg segment **62*b*' is turned downwardly so that there is a greater tendency for material supported thereon to flow off of the upper surface of the flight member and be released into the showering zone 74. This means that product to be dried is delivered into the rightmost corner of the showering zone for heat transfer and pneumatic separation between the hot products of combustion directed through the showering zone and the fragmented product. Material will have also fallen onto the top of dog-leg member 62 from the overlying narrow flight member 50**.

The dog-leg member 64' at a 2:00 position in FIG. 6 having a leg segment **64*b*' is at a greater angle than the leg segment 58*b* of the underlying flight member 58', but by virtue of the relatively narrow width of leg segment 64*b*' of the flight member 64' when in that disposition, will somewhat retard release of material but still allow some product to fall into the showering region 74 immediately to the left of the material released from underlying flight member 62'**.

The overlying straight wide flight member 54'' at a position of about 1:30 releases material into the showering zone to the left of that delivered from dog-leg shaped flight member 54' but the upturned leg segment 56'' again serves to somewhat impede release of material.

The somewhat longer inner leg segment **58*b*'' of dog-leg member 58'' above straight flight member 54'' stores material while still allowing some product to flow into the showering zone to the left of material gravitating from the outermost end of straight member 54''. The greater length of leg segment 58*b*'' assures that material is collected in the channel-shaped area thereof but still allow some of the material to be delivered from the innermost end of the flight member. Return segment 60'' on the end of dog-leg member 58'' contributes to regulation of flow from the member 58'' since it is to be noted that at this position of such member, the outermost major leg segment 58*a*''** is in a relatively upright position where material may readily fall therefrom.

The dog-leg shaped flight member 62''' in FIG. 6 at a 1:00 position is moving toward vertical disposition and now will start to deliver virtually all of the material initially contained thereon into the zone 74. Flight member 64''' to the left of member 62''' in the 12:30 position, while delivering material into the showering zone 74 causes some of such material to be retained by virtue of the leg segment **64*b*''' on the innermost extremity thereof. Even the straight member 56'''' at the 12:00 position will retain some material on the inner extremity thereof by virtue of the return segment 56''''**.

The hook-shaped pattern of the dog-leg shaped members 54, 58, and 64 assist in carrying material beyond the upright center plane of the showering region 74 so that there is material delivered into such zone to the left of such upright center plane as also depicted in FIG. 6. It is to be recognized in this respect that the depiction of material on the flight members as shown schematically in FIG. 6 is for generally illustrative purposes only and that by virtue of rotation of the drum 26 in a counterclockwise direction viewing FIG. 6, material will to a certain extend be thrown toward the left side of the showering zone 74 by a combination of momentum and centrifugal force. The vertical dotted lines **74*a* in FIG. 6 are intended to schematically represent the flight of fall patterns of moisture-bearing fragmented product which is delivered from the flight members during rotation of the drum 26 substantially throughout the horizontal extent of showering region or zone 74**.

Viewing FIGS. 6 and 7, it can be seen that in a preferred arrangement of the flight patterns of rows 1–11 (FIG. 10), the non-linear dispositions of the outer leg segments of the dog-leg shaped flight members 58, 62 and 64 contribute to prevention of blockage of material between the flight members and assures that the openings thereof remain free at all times. For example, the leg segments **58*a* are directed away from leg segments 62*a* to the right thereof, which are on the opposite side of respective radial lines to compensate for the fact that leg segments 58*b* and 62*b* of adjacent flight members project toward one another. On the other hand, leg segments 62*a* and 64*a* of adjacent flight members are non-radial toward one another but the opening presented by their inner leg segments 62b and 64b diverge so that there is a tendency of the material to flow outwardly therefrom even though respective adjacent outer leg segments 62a and 64a converge to a limited extent. The intermediate flight members 50 are no factor insofar as a tendency to bridge is concerned because of the relatively narrow extent of such members radially of the drum 26**.

In typical three-pass dryers heretofore available, the temperature of the hot products of combustion directed into the inlet of such dryers sometimes ran as high as 2,000° to 2,200° F. For fuel efficiency and conservation purposes, that temperature is now limited to about 1,200° F. The moisture content of the material to be dried frequently ran as high as about 85%, but now rarely exceeds 70% and usually is in the range of 35-60%. Assuming an output moisture content not exceeding about 10%-15% which is a frequently encountered product specification requirement, the three-pass dryers in operation usually have a hot gas temperature output of about 210° F. Airflow rates were in the order of 11,000 cubic feet per minute for a 8'×24' three pass dryer.

It is desirable to obtain require drying of the products at the lowest feasible temperature in order to reduce stress on the material, prevent burning and restrict the amount of fuel consumed in the process. All of these parameters must be met at a capital expenditure cost for equipment which is reasonable.

These objectives are met with the present invention by providing a maximum area of heat transfer surface or either metal or product with few if any voids of holes in the showering zone 74 which would allow hot gases to pass through without heat exchange with the moist product. The large area of metal flight surfaces serves to create high convective and conductive heat exchange areas.

The present invention provides unexpected benefits in maximizing heat transfer surface area not only of the metal flights but also of the fragmented material to be dried, but also by doing so in a manner that negates the necessity of utilizing a three-pass, tortuous path heat exchanger with its attendant heat stress, inefficiencies and relatively costly construction. This objective is met in the present invention by virtue of the fact that high capacity with minimum heat stress is obtained because a greater number of pounds of hot gas is forced through the heat exchanger while exchanging most of the available heat, and discharging the product at the proper moisture content. For example, in an 8×24 three-pass dryer, which has a 16M btu per hour heat source, and an 11,000 cfm airflow, the same components will allow an airflow of 15,700 cfm when modified to incorporate the components of the present invention. Thus, the dryer capacity is proportionately increased with a lower discharge temperature, less heat stress and more uniform control.

The efficiency of the present single pass dryer as compared with conventional three-pass dryers has been demonstrated by conversion of 8'×24' dryers, as well as 10.4'×30' three-pass dryers to single pass dryers incorporating the features and components of this invention.

This is illustrated by the following exemplary tables of optimum achievable results:

| | Before | After |
|---|---|---|
| 8' × 24' 3-Pass Dryer Conversion | | |
| Airflow at discharge | 11,000 acfm | 15,700 acfm |
| Discharge temperature | 160° F. | 140° F. |
| Drum (heat exchanger) size | 8' dia. × 24' long | same |
| Primary fan HP requirement | 50 HP | 70 HP |
| Drum speed | 10 rpm | same |
| Heat source maximum capacity | 16 MMBTU/hr. | same |
| Metal heat transfer surface | 3084 ft.$^2$ | 3900 ft.$^2$ |
| Fragmented product total heat transfer surface @ 4 ft.$^2$/pd. | 735 pd. × 4 = 2940 ft.$^2$ | 1764 pd. × 4 = 7056 ft.$^2$ |
| Retention time | 4 min. | 6 min. |
| Total square feet of heat transfer surface | 6024 ft.$^2$ | 10956 ft.$^2$ |
| 25% Moisture Suncure product input | 5 tonnes/hr. 12% moisture finished prod. | approx. 8 tonnes/hr. 12% moisture finished prod |
| 10.5' × 30 3-Pass Dryer Conversion | | |
| Airflow at discharge | 28,000 acfm | 40,000 acfm |
| Discharge temperature | 210° F. | 180° F. |
| Drum (heat exchanger) size | 10'4" dia. × 30' long | same |
| Primary fan HP requirement | 70 HP | 125 HP |
| Drum speed | 8 rpm | same |
| Heat source maximum capacity | 28 MMBTU/hr. | same |
| Metal heat transfer surface | 5342 ft.$^2$ | 7335 ft.$^2$ |
| Fragmented product total heat transfer surface @ 4 ft.$^2$/pd. | 760 pd. × 4 = 3040 ft.$^2$ | 1600 pd. × 4 = 6500 ft.$^2$ |
| Retention time | 4 min. | 6 min. |
| Total square feet of heat transfer surface | 8383 ft.$^2$ | 13735 ft.$^2$ |
| 60% Moisture Wilted dehy product input | 5.7 ton/hr. 12% moisture Finished prod | 8 ton/hr. 12% moisture Finished prod |

DETAILED DESCRIPTION OF THE PREFERRED EMBODIMENT OF THE INVENTION a. Drum Dryer

The preferred embodiment of an elongated, generally horizontal, hollow drum heat exchanger for use in a single pass dehydration system 20 as depicted in FIG. 1, is illustrated in FIGS. 13-19 of the drawings and designated generally by the numeral 226. It is to be noted in this respect that drum heat exchanger 226 may have flighting 248 of the type illustrated in connection with the embodiment shown in FIGS. 2-7 of the drawings, the embodiment of FIGS. 8-10, or in the alternative as shown in FIGS. 11 and 12.

The drum dryer 226 has a cylindrical shell 246 which is typically of essentially the same dimensions as those specified above for cylindrical shell 46. Thus, the shell 246 may have flights 248 of configurations and dimensions the same as or similar to those previously described and specifically depicted in FIGS. 2-12 inclusive.

Figure 13:
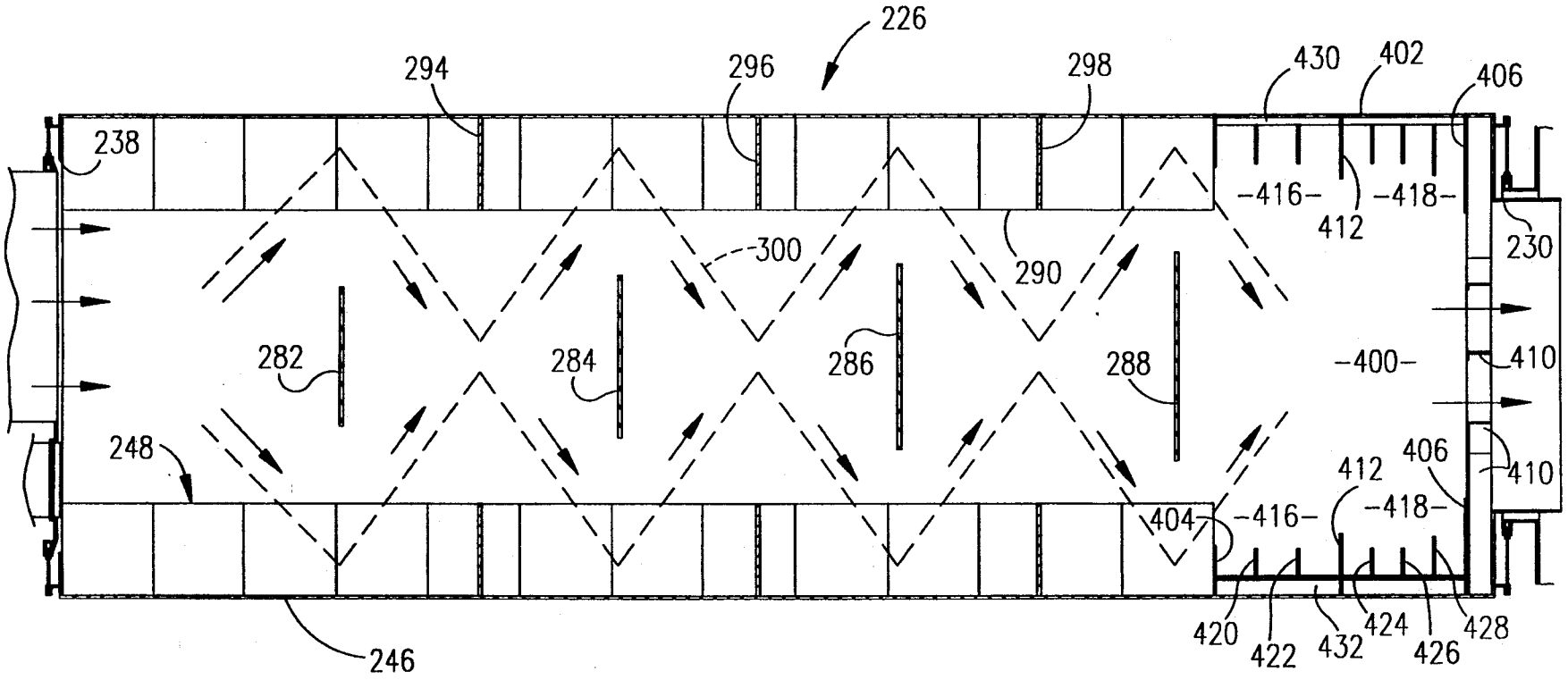
FIG. 13 is a preferred embodiment of an essentially schematic, enlarged, fragmentary vertical cross-sectional view of a drum heat exchanger constructed in accordance with the present invention and incorporating a series of transversely oriented, axially spaced circular baffles within the drum and an alfalfa stem dryer section at the outlet end of the dryer.
Figure 14:
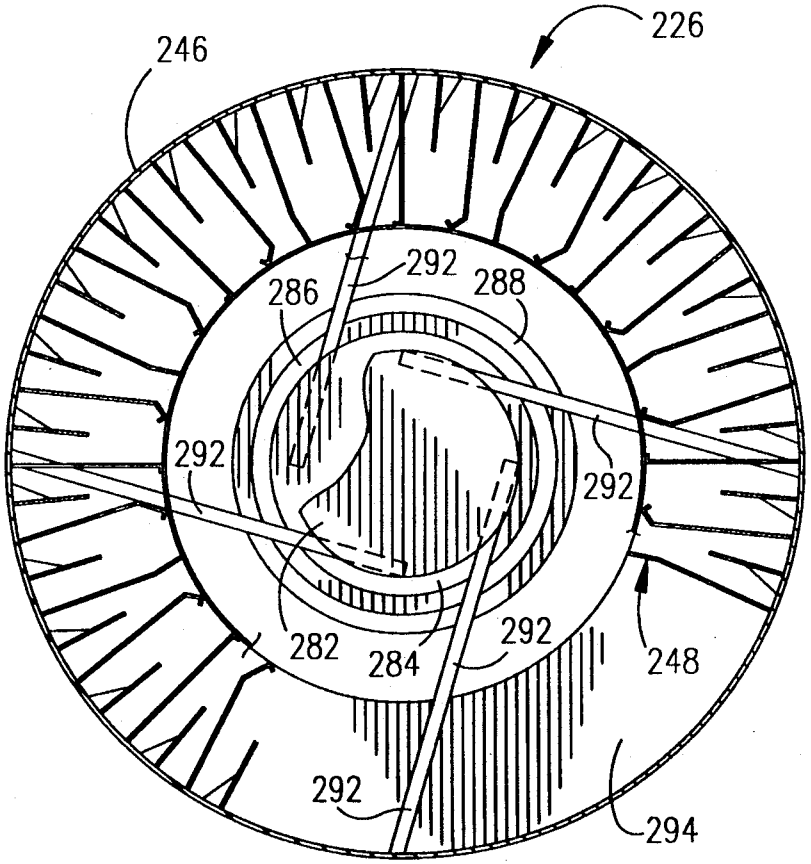
FIG. 14 is an enlarged vertical cross-sectional view through the drum of FIG. 13 and taken substantially on a transverse line to the left of the first baffle at the inlet end of the dryer and looking toward the outlet end of the drum.

The principle difference between drum dryer 226 and the previously described embodiments thereof is the provision of a series of transversely oriented, axially spaced, circular discs or baffles 282, 284, 286 and 288 respectively as thus shown in FIGS. 13 and 14. It is to be seen from FIG. 13 that the peripheral edges of each of the discs 282–288 respectively are spaced inwardly from the innermost circumferentially extending margin 290 of the flighting 248 projecting inwardly from the interface of cylinder 246.

The baffles 282–288 are of successively greater diameter in a direction extending from the inlet in 238 of drum 226 toward the outlet end 230 thereof. Viewing FIG. 14 it is to be noted that four struts 292 carry each of the baffles 282–288 in proper transverse disposition with the outer end of each of the struts being suitably welded or otherwise affixed to the inner surface of cylindrical drum 246 while the inner end of each strut is welded to one face of a corresponding disc 282–288. The struts 292 are preferably oriented so that they are essentially tangential to the margins of respective baffles 282–288 in order that the discs supported thereby may rotate as they expand to prevent a fracture of the well joints during operation of the dryer.

A series of annular deflectors 294, 296 and 298 respectively are mounted within dryer cylinder 246 between adjacent baffle discs 282–288 inclusive as depicted in FIG. 13. Each of the deflectors 294–298 is imperforate except for the central opening defined thereby. Means such as welding is employed to secure the deflectors 294–298 to the inner surface of cylinder 246 in locations such that each is mid-way longitudinally of drum 226 between adjacent discs 282–288.

It is apparent from the schematic depiction of FIG. 13 that the baffle discs 282–288 and associated deflectors 294–298 cooperate to cause the material being dried and the hot products of combustion directed into drum 246 through inlet 238 to follow an essentially serpentine path 300 along the length of the dryer 226. It is to be appreciated in this respect that the serpentine path 300 of the particles being dried and the hot products of combustion is also somewhat helical in nature in that the products, and to a somewhat lesser extent the heated gases, are caused to rotate to a certain extent within the interior of the drum 226 as the drum is rotated about its longitudinal axis.

In a preferred drum dryer which is approximately 10.5 feet in diameter, disc baffle 282 should be about 36 inches in diameter, disc 284 about 42 inches in diameter, disc 286 about 48 inches in diameter and disc 288 about 54 inches in diameter. Disc 282 is preferably spaced about 6 feet from the inlet 238 of drum 226 while the spacing between adjacent disc baffles is also about 6 feet. Thus, the annular deflectors 294–298 are also spaced about 6 feet one from another. In the exemplary 10.5 foot diameter dryer, each of the annular deflectors 294–298 extends inwardly of the cylinder 246 to the same extent as flights 248. Thus, the peripheral margins of discs 282–288 are spaced from an imaginary cylinder extending through the inner margins of each of the deflectors 294–298. The diameter of each opening defined by a respective deflector 294–298 therefore should be about 6 feet 4 inches.

b. Stem Dryer

Stem dryer section 400 located adjacent the outlet end dryer drum 226 is made up of tubular structure defined by the cylindrical end section 402 of shell 246, along with annular components making up a series of annular drying compartments extending circumferentially of the drum.

The innermost annular retainer ring 404 of dryer section 400 defines the inlet thereof and is positioned adjacent the dryer outlet end of flighting 248. Retainer ring 404 is imperforate except for the central opening therein. Ring 404 preferably should have a height of about 12 inches in the case of a 10.5 foot diameter dryer drum and therefore defines a cylindrical opening of about 8 feet 2 inches.

The outermost, annular discharge ring 406 of stem dryer section 400 having an effective height of about 25 inches is secured to the inner surface of cylindrical section 402 and defines a generally circular opening of having a diameter of about 6 feet 2 inches in the case of the representative 10.5 foot diameter drum. The discharge ring 406 has four equally spaced, V-shaped, outwardly extending, 60° notches 408 in the inner margin thereof. The depth of each of the notches 408 is approximately one-half the height of the ring 406 as is apparent from FIG. 18. Eight elongated, transversely L-shaped scoops 410 of conventional construction are secured to the outer face of discharge ring 406 in radial relationship thereto and located such that they are not in alignment with any of the notches 408 from FIGS. 13 and 15, it can be seen that discharge ring 406 is located inwardly of the discharge outlet 230 a sufficient distance to accommodate scoops 410 therebetween.

As can be best observed from schematic sectional view FIG. 13, it can be observed from that figure that an intermediate annular ring 412 having an effective height of about 15 inches is secured to the inner surface of cylindrical section 246 one-half of the way between rings 404 and 406. In the instance of a 10.5 foot diameter drum, the opening defined by the inner margin of ring 412 is therefore about 8 feet. Ring 412 is provided with eight equally spaced, outwardly extending, 30° V-shaped notches 414 in the inner periphery thereof. As can be seen from FIG. 17, notches 414 are out of alignment with the notches 408 in discharge ring 406. Retainer ring 404 and intermediate ring 412 cooperate to define a first, annular inner stem drying chamber 416, while intermediate ring 412 cooperates with discharge ring 406 to define an outer annular stem drying chamber 418.

Annular chamber 416 is provided with transversely oriented, inwardly directed, axially spaced heat transfer fin members 420 and 422, while chamber 418 has similar fin members 424 and 426 along with a fin member 428. Each of the fin members 420–426 has an effective height of about 12 inches while fin member 428 is about 14 inches high, when fabricated to be incorporated in a 10.5 foot diameter drum.

Figure 15:
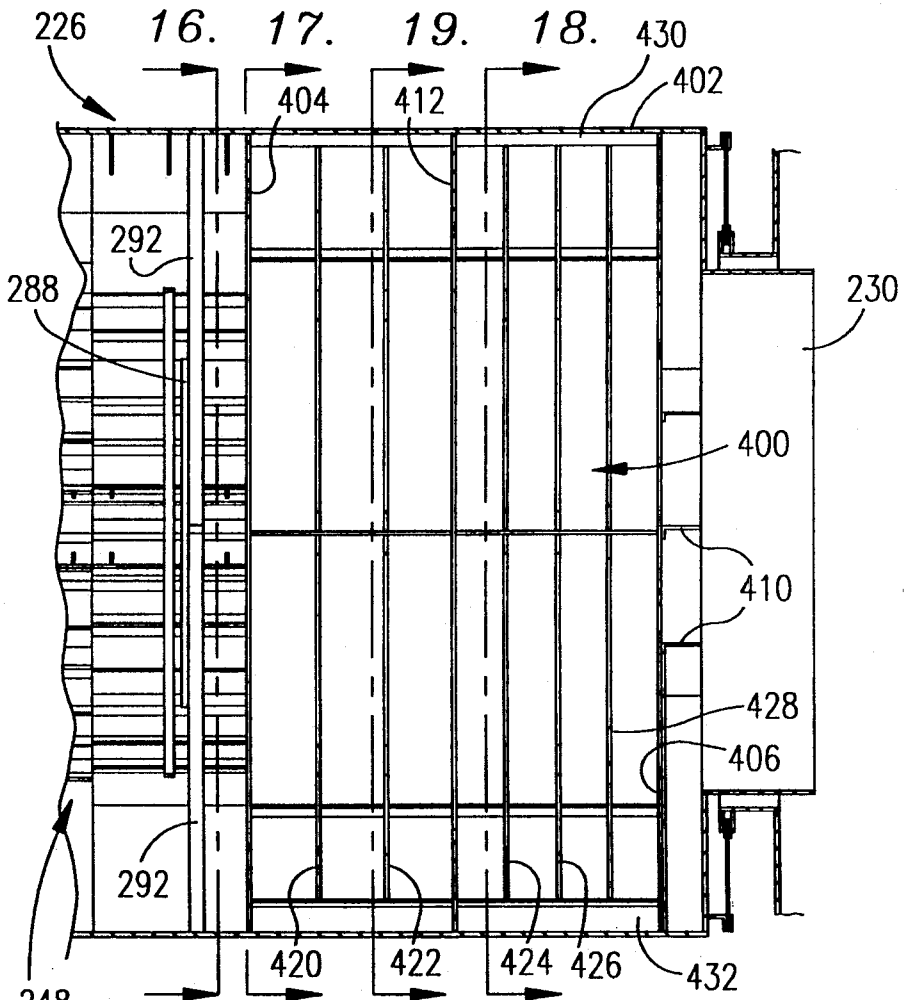
FIG. 15 is an enlarged fragmentary of the outlet portion of the drum dryer and more specifically illustrated the construction of the stem dryer.
Figure 18:
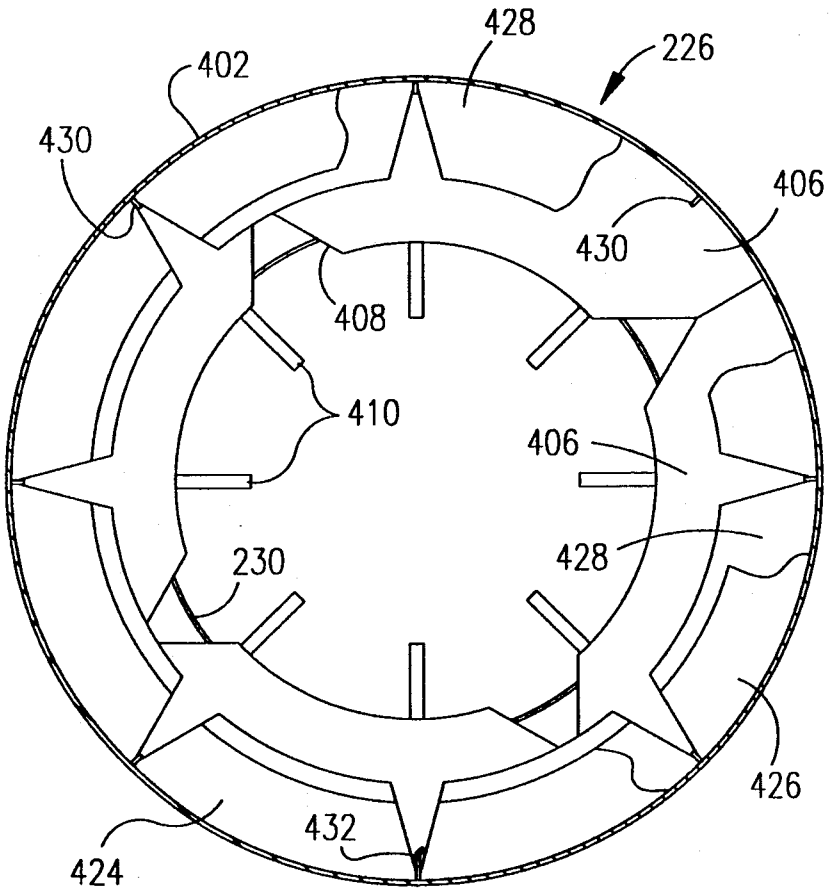
Figure 17:
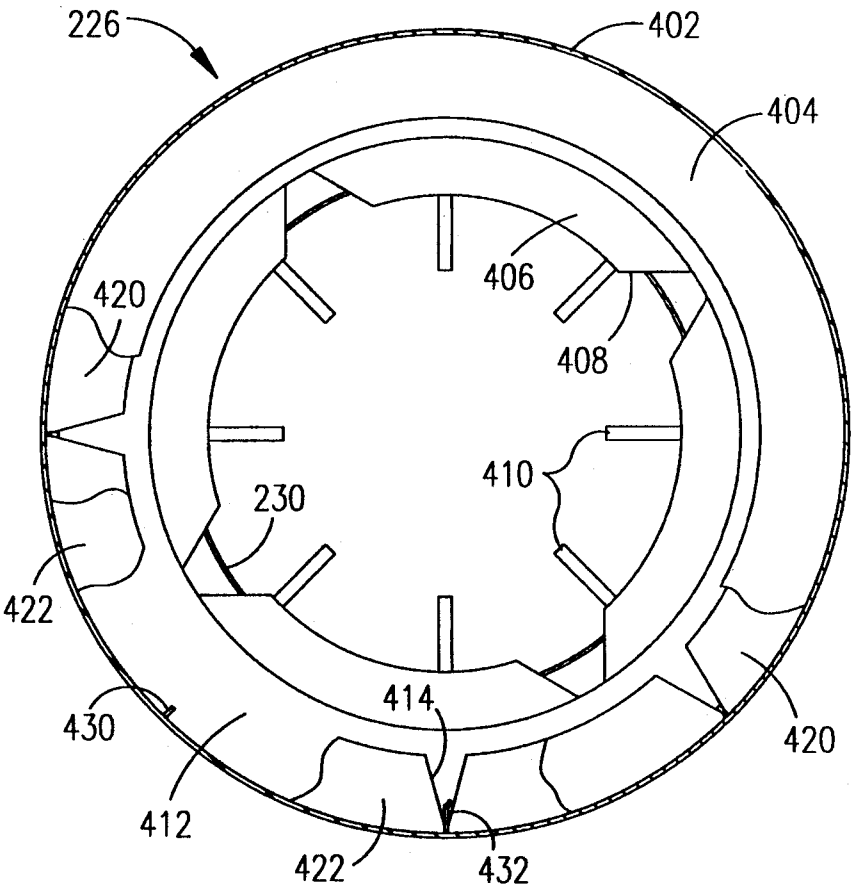

It is also apparent from FIGS. 13 and 15 that fin members 420–428 which are welded to the inner surface of cylindrical section 402 are equidistantly spaced from one another and from an adjacent retainer ring, intermediate ring or discharge ring, longitudinally of the dryer drum. Viewing FIGS. 17 and 18, it can be seen that each of the compartments 416 and 418 has seven inwardly directed mixing flight members 430 aligned with seven of the notches 414, and one dog-leg shaped mixing flight 432 aligned with the other notch 414. The dog-leg flight 432 is of greater height than flights 430. In the exemplary 10.5 foot dryer drum, flights 430 are preferably 2 inches high, while the flight 432 has a major leg 4 inches high, with the upper angle segment thereof being at a 45° angle with respect to the main leg and of an effective height of about 1 inch.

Operation of the Preferred Embodiment

When drum dryer 226 is used to remove moisture from alfalfa, the crop to be dried generally has a moisture content in the range of 35%-80%. That moisture level should be reduced in the dryer to about 12%. In order to accomplish this, and in the representative case where the drum is about 10.5 feet in diameter and 40 feet long, is rotated at about 8 rpm's, and hot gases at a temperature in the range of about 700° to about 1800° F. at the inlet of the dryer, and introduced at an airflow volume rate of about 30,000 cfm, is adequate in most instances. Many windrowed alfalfa inputs to dehy dryers today have a moisture content as low as about 35% moisture to minimize the energy requirements for water removal. In the case of 35% moisture alfalfa input to the dryer, the hot gas temperature at the dryer inlet can be maintained as low as about 700° F. However, it may be necessary to use an inlet temperature as high as 2000° F. to dry very wet alfalfa. The temperature of the gases exiting the dryer usually will be between 200°-250° F. and the product at a temperature of about 110°-130° F. Generally, the residence time of the product in a dryer of the dimensions indicated is about 5 minutes. A temperature controller is employed at the exit of the dryer which regulates the temperature of the heated gases introduced into the inlet of the dryer by turning the burner up or down as necessary to assure proper drying of the alfalfa product.

The provision of baffle discs 282-288 and associated deflectors 294-298 increase the air path through drum to an extent which is about 50% greater than is the case without such baffles and deflectors. Thus, the residence time and material is about a medium value between that of a conventional single pass dryer and a three pass dryer. However, there is only about a 30% decrease in air volume. For example, if the air volume in is approximately 50,000 cfm it has been found that the air volume out will be about 30,000 cfm. The baffle discs 282-288 increase in diameter as the discharge end of the dryer is approached in order to gradually increase to maintain the heated gas velocity notwithstanding the fact that the flow rate of the material being dried remains essentially uniform, noting in this respect that the weight of the product being dried decreases as the product traverses the length of the dryer. Thus, the heated air velocity will increase in a typical system from about 380 ft/m adjacent disc 282 to about 460 ft/m at the disc 288. The longer serpentine and helical path that the material is required to follow through dryer 226 causes the product being dried to be exposed to the hot gases for a longer time period, and at the same time allows the metal to absorb heat from the gas for a greater period thus increasing the heat transfer efficiency from the metal to the product.

The leaves of the alfalfa dry more readily than the stems. When the inlet gas temperature is raised to a level to effectively dry the stems to the desired 12% moisture content, the leaves may be subjected to excessive temperature for a time such that burning of the leaves can occur, or the full nutrient value of the leaves degraded or partially or completely destroyed.

The provision of stem dryer section 400 allows the leaves to be discharged from the dryer more quickly than the stems so that the alfalfa stems may be subjected to the heated gas for a longer interval of time than the leaves. To this end, leaves which have reached the desired moisture level, tend to directly exit from the dryer when the leaves reach the stem dryer section. However, those wet stems which are heavier than the dry leaves at that point in the dryer gravitate toward the bottom of the compartments 416 and 418 and remain in such compartments until the required 12% moisture level is attained.

Figure 19:
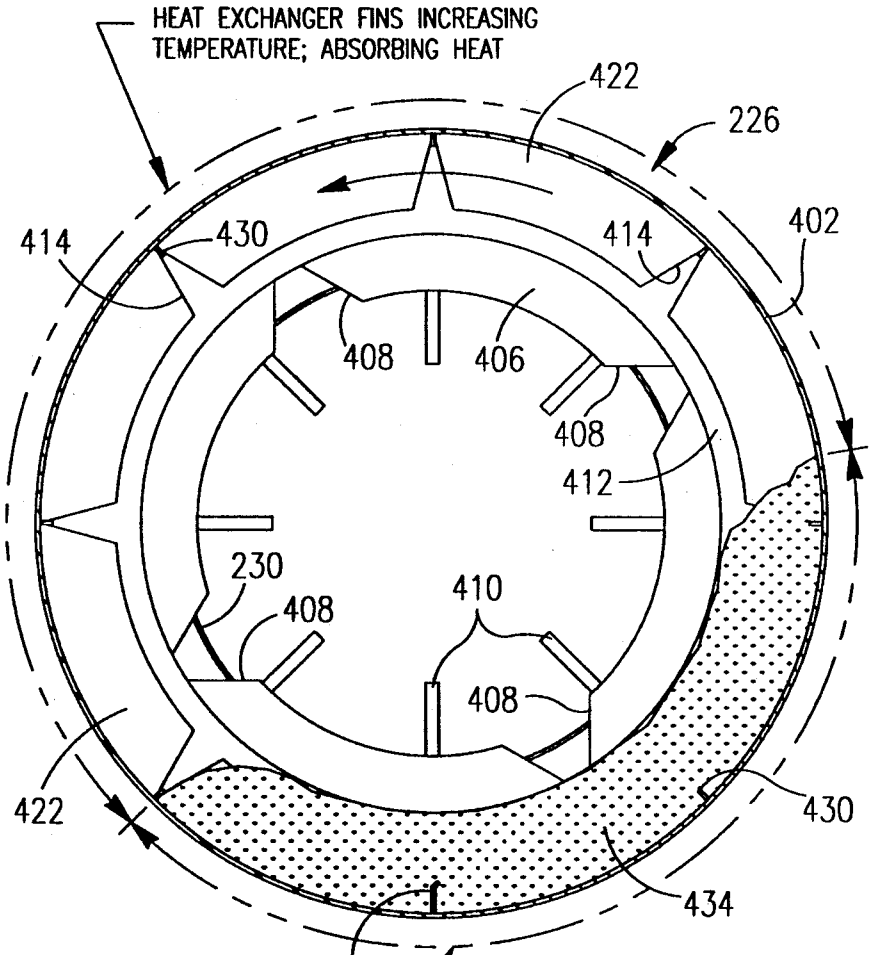
FIGS. 16, 17, 18 and 19 are vertical cross-sectional views taken along respective lines 16—16, 17—17, 18—18 and 19—19 of FIG. 15.
Figure 16:
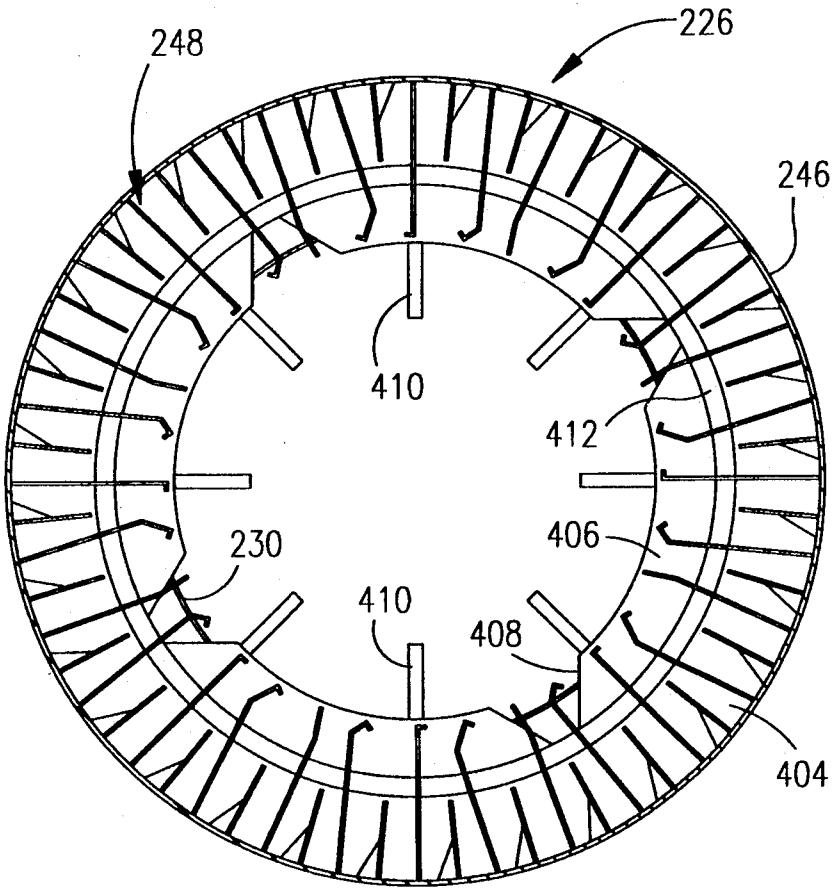

When the stems accumulate in chambers 416 and 418, rotation of the drum in a direction indicated by the arrow in FIG. 19, causes the stems to tend to collect and move upwardly in the direction of rotation reflected by the accumulated body of material 430 in FIG. 19. The purpose of fin members 420-428 is to transfer thermal energy from respective fin members to the alfalfa stems. As the drum rotates, the fin members are subjected to the hot products of combustion flowing through the stem dryer section 400 during the arcuate path of the fin members reflected by the numeral 436 of FIG. 19, thus causing the fin members to be raised to a temperature approaching that of the hot gases. During the arcuate rotational path of the drum represented by the numeral 438 in FIG. 19, the heat stored in the fin members is transferred by conduction to the alfalfa stems thus promoting enhanced drying of the products.

Flights 430 and 432 in chambers 416 and 418 not only agitate the stems for most efficient transfer of heat to the stems from the fin members, but also enhance migration of the stems during drying thereof from chamber 416 to chamber 418 via notches 414 when the latter are positioned at the bottom of their paths of travel and during the period such notches are in the area represented by the accumulated body of material 434. In like manner, notches 408 in discharge ring 406 allow migration of material from chamber 418 into the discharge in 230 of the dryer 226. Scoops 410 assure that product will empty from the dryer and also kick out any rocks that might tend to accumulate in stem dryer 400.

It has been determined that there is a good correlation between the temperature of the heat transfer surfaces of the fin members 420-428 and the rings 404, 406 and 412, the temperature of the product to be dried, the product volume, the residence time of the material in the chambers 416 and 418, and the amount of moisture which is removed per unit of time. Thus, if more water must be removed for a particular type of product, this can simply be accomplished by adding more fin members in compartments 416 and 418, or to provide additional compartments with a requisite number of fin members as determined by calculation of the parameters as set forth above.

The spacing of fin members 420-428 as depicted in the drawings is what has been found most effective for removing moisture from alfalfa. However, if the dryer 226 is to be employed for removing moisture from finely comminuted materials such as bakery wastes, wood products or the like, again more effective results can be obtained by adding more closely spaced fin members to the chambers 416 and 418.

I claim:

1. In a high density, single pass heat exchanger for drying fragmented moisture-bearing products, the combination of:

an elongated, generally horizontal, hollow drum heat exchanger having a sidewall, a moist product receiving inlet, and a dried product outlet;

means for creating a flow of heated gases through the drum from the inlet to outlet thereof to exchange heat and thereby cause evaporation of water from the products while the latter are in the drum;

a series of circumferentially spaced, inwardly directed, product conveying and showering, conductive and convective heat transfer flights extending inwardly toward the center of the drum from the inner surface of the sidewall thereof, said flights terminating in spaced relationship from the center of the drum to define an inner flight-free, product-showering and conveyance zone, the diameter of the drum (R) divided by the effective diameter of said zone (r) being equal to an aspect ratio (R/r) of at least about 1.4;

means for rotating the drum about its longitudinal axis, there being a sufficient number of said flights with respect to the circumferential extent of the drum and the dimensions of said flights transversely and longitudinally of the drum being adequate to provide heat conductive and convective flight surfaces that have a total heat transfer surface area at least about as large as the total heat transfer surfaces presented by the products to be dried which are flowing through the heat exchanger at its maximum rated product throughput capacity;

a series of baffles mounted within said zone of the drum in disposition extending transversely of said zone and located in axially spaced relationship along the length of the drum; and a series of annular deflectors projecting outwardly from the inner surface of the drum side wall in disposition between adjacent baffles and oriented in association with the latter to cause the flow of heated gases and the product flowing therethrough to follow a serpentine, generally helical path longitudinally of the drum between said inlet and the outlet thereof.

2. A high density, single pass heat exchanger as set forth in claim 1, wherein said baffles comprise a series of circular discs each extending transversely of the drum, the peripheral edges of said discs being spaced from an imaginary cylinder passing through the innermost margins of said deflectors.

3. A high density, single pass heat exchanger as set forth in claim 2, wherein said baffles are of successively increasing diameter as the outlet end of the drum is approached.

4. A high density, single pass heat exchanger as set forth in claim 3, wherein the peripheral edge of each of the baffles is spaced inwardly from the innermost extremities of said flights defining the outer extent of said zone.

5. A high density, single pass heat exchanger as set forth in claim 1, wherein said aspect ratio is within the range of about 2.4 to about 1.4.

6. A high density, single pass heat exchanger as set forth in claim 1, wherein said flights comprise sheet members extending longitudinally of the drum with the angularity of the flights in a direction radially of the drum varying between adjacent flight members.

7. A high density, single pass heat exchanger as set forth in claim 1, wherein said flights comprise sheet members extending longitudinally of the drum with the dimensions of the flights in directions radially of the drum varying between adjacent flight members.

8. A high density, single pass heat exchanger as set forth in claim 7, wherein is provided ring elements joined to the innermost extremities of the sheet members which define said zone for stabilizing the sheet members attached to said ring elements and to maintain the spaced relationship thereof circumferentially of the drum.

9. A high density, single pass heat exchanger as set forth in claim 8, wherein is provided a series of said ring elements arranged longitudinally of the drum with each of said ring elements being of relatively narrow configuration to prevent significant interference thereof with release of material into the showering and conveyance zone from the sheet members during rotation of the drum.

10. A high density, single pass heat exchanger as set forth in claim 1, wherein said flights comprise sheet members extending longitudinally of the drum with at least certain of the sheet members being provided with angular hook segments on the innermost extremities thereof to assure more uniform dispersion of the fragmented product as it is released for fall into and through said flight-free showering and conveyance zone during rotation of the drum.

11. A high density, single pass heat exchanger as set forth in claim 1, wherein said flights comprise sheet members extending longitudinally of the drum with certain of the sheet members being oriented in a direction radially of the drum while others are non-radial with respect to the drum axis.

12. A high density, single pass heat exchanger as set forth in claim 11, wherein certain of said non-radial sheet members are of dog-leg configuration transversely of the drum.

13. A high density, single pass heat exchanger as set forth in claim 12, wherein certain of said dog-leg shaped sheet members have an outer leg segment adjacent the inside of the drum at an angle of about 7° with respect to radial, and an inner leg segment at an angle of about 143° causing the inner leg segment thereof to be at an angle of about +25° with respect to radial.

14. A high density, single pass heat exchanger as set forth in claim 12, wherein certain of said dog-leg shaped sheet members have an outer leg segment adjacent the inside of the drum at an angle of about 4° with respect to radial, and an inner leg segment at an angle of about 161° causing the inner leg segment thereof to be at an angle of about −15° with respect to radial.

15. A high density, single pass heat exchanger as set forth in claim 12, wherein certain of said dog-leg shaped sheet members have an outer leg segment adjacent the inside of the drum at an angle of about 3.5° with respect to radial, and an inner leg segment at an angle of about 131.5° causing the inner leg segment thereof to be at an angle of about +45° with respect to radial.

16. A high density, single pass heat exchanger as set forth in any one of claims 13 or 15, wherein each of said dog-leg shaped sheet members is provided with a terminal leg segment adjacent said zone which is at an angle of about 90° with respect to the adjacent part of a respective sheet member.

17. In a high density, single pass heat exchanger for drying fragmented moisture-bearing products, the combination of:

an elongated, generally horizontal, hollow drum heat exchanger having a sidewall, a moist product receiving inlet, and a dried product outlet;

means for creating a flow of heated gases through the drum from the inlet to outlet thereof to exchange heat and thereby cause evaporation of water from the products while the latter are in the drum;

a series of circumferentially spaced, inwardly directed, product conveying and showering, conductive and convective heat transfer flights extending inwardly toward the center of the drum from the inner surface of the sidewall thereof, said flights comprising sheet members extending longitudinally of the drum with the angularity and dimensions of the flight members in a direction radially of the drum varying between adjacent flights, while certain of the sheet members are oriented in a direction radially of the drum with others being non-radial with respect to the drum axis, certain of said non-radial sheet members being of dog-leg configuration transversely of the drum, said flights being arranged in a series of discrete sections longitudinally of the drum, with at least a part of the flighting pattern of one section being rotated axially of the drum with respect to an adjacent section.

said flights terminating in spaced relationship from the center of the drum to define an inner flight-free, product-showering and conveyance zone, the diameter of the drum (R) divided by the effective diameter of said zone (r) being equal to an aspect ratio (R/r) of at least about 1.4;

means for rotating the drum about its longitudinal axis, there being a sufficient number of said flights with respect to the circumferential extent of the drum and the dimensions of said flights transversely and longitudinally of the drum being adequate to provide heat conductive and convective flight surfaces that have a total heat transfer surface area at least about as large as the total heat transfer surfaces presented by the products to be dried which are flowing through the heat exchanger at its maximum rated product throughput capacity.

18. A high density, single pass heat exchanger as set forth in claim 17, wherein at least a part of the second section of flighting from the inlet end of the drum is rotated about 11.25° counterclockwise with respect to the first section in closest spaced relationship to the inlet end of the drum.

19. A high density, single pass heat exchanger as set forth in claim 18, wherein at least a part of the third section of flighting from the inlet end of the drum is rotated about 22.5° counterclockwise with respect to said first section of flighting.

20. A high density, single pass heat exchanger as set forth in claim 19, wherein at least a part of the fourth section of flighting from the inlet end of the drum is rotated about 33.75° counterclockwise with respect to said first section of flighting.

21. A high density, single pass heat exchanger as set forth in claim 20, wherein a fifth section of flighting from the inlet end of the drum is provided with flight sheet members which are aligned with the flight sheet members of the first section.

22. A high density, single pass heat exchanger as set forth in claim 21, wherein at least a part of the sixth section of flighting from the inlet end of the drum is rotated about 11.25° counterclockwise with respect to said first and fifth flighting sections.

23. A high density, single pass heat exchanger as set forth in claim 22, wherein at least a part of the seventh section of flighting from the inlet end of the drum is rotated about 22.5° counterclockwise with respect to the first and fifth flighting sections.

24. A high density, single pass heat exchanger as set forth in claim 23, wherein at least a part of the eighth section of flighting from the inlet end of the drum is rotated about 33.75° counterclockwise with respect to the first and fifth flighting sections.

25. A high density, single pass heat exchanger as set forth in claim 24, wherein a ninth section of flighting from the inlet end of the drum has sheet members which are aligned with the sheet members of the first and fifth flighting sections.

26. A high density, single pass heat exchanger as set forth in claim 25, wherein at least a part of the tenth section of flighting from the inlet end of the drum is rotated about 11.25° counterclockwise with respect to the first, fifth and ninth flighting sections.

27. A high density, single pass heat exchanger as set forth in claim 26, wherein at least a part of the eleventh section of flighting from the inlet end of the drum is rotated about 22.5° counterclockwise with respect to the first, fifth and ninth flighting sections.

28. A high density, single pass heat exchanger as set forth in claim 17, wherein certain of said dog-leg shaped sheet members have an outer leg segment adjacent the inside of the drum at an angle of about 6.25° with respect to radial, and an inner leg segment at an angle of about 143.75° causing the inner leg segment thereof to be at an angle of about +30° with respect to radial.

29. A high density, single pass heat exchanger as set forth in claim 28, wherein certain of said dog-leg shaped sheet members have an outer leg segment adjacent the inside of the drum at an angle of about 7° with respect to radial, and an inner leg segment at an angle of about 128° causing the inner leg segment thereof to be at an angle of about +45° with respect to radial.

30. A high density, single pass heat exchanger as set forth in claim 29, wherein certain of said dog-leg shaped sheet members have an outer leg segment adjacent the inside of the drum at an angle of about 4.75° with respect to radial, and an inner leg segment at an angle of about 160.25° causing the inner leg segment thereof to be at an angle of about +15° with respect to radial.

31. A high density, single pass heat exchanger as set forth in any one of claims 28, 29, or 30, wherein each of said dog-leg shaped sheet members is provided with a terminal leg segment adjacent said zone which is at an angle of about 90° with respect to the adjacent part of a respective sheet member.

32. A high density, single pass heat exchanger as set forth in claim 30, wherein certain of said dog-leg shaped sheet members have an outer leg segment adjacent the inside of the drum at an angle of about 5° with respect to radial, and an inner leg segment at an angle of about 160° causing the inner leg segment thereof to be at an angle of about −15° with respect to radial.

33. A high density, single pass heat exchanger as set forth in claim 17, wherein certain of the radial flight members are of generally the same width as the members of dog-leg shaped configuration, with at least certain of the radial flight members of the same width as said dog-leg shaped members being provided with terminal return leg segments adjacent said zone which are at an angle of about 90° with respect to such members.

34. A high density, single pass heat exchanger as set forth in claim 33, wherein one-half of said radial flight members of the same width as said dog-leg shaped members are provided with terminal return leg segments extending in the direction of rotation of the drum.

35. A high density, single pass heat exchanger as set forth in claim 32, wherein said flights are arranged in a series of discrete sections longitudinally of the drum, with at least a part of the flighting pattern of one section being rotated axially of the drum with respect to an adjacent section.

36. A high density, single pass heat exchanger as set forth in claim 35, wherein at least a part of the second section of flighting from the inlet end of the drum is rotated about 15° counterclockwise with respect to the first section in closest spaced relationship to the inlet end of the drum.

37. A high density, single pass heat exchanger as set forth in claim 36, wherein at least a part of the third section of flighting from the inlet end of the drum is rotated about 45° counterclockwise with respect to said first section of flighting.

38. A high density, single pass heat exchanger as set forth in claim 37, wherein at least a part of the fourth section of flighting from the inlet end of the drum is rotated about 75° counterclockwise with respect to said first section of flighting.

39. A high density, single pass heat exchanger as set forth in claim 38, wherein a fifth section of flighting from the inlet end of the drum is provided with flight sheet members which are aligned with the flight sheet members of the first section.

40. A high density, single pass heat exchanger as set forth in claim 39, wherein at least a part of the sixth section of flighting from the inlet end of the drum is rotated about 15° counterclockwise with respect to said first and fifth flighting sections.

41. A high density, single pass heat exchanger as set forth in claim 40, wherein at least a part of the seventh section of flighting from the inlet end of the drum is rotated about 45° counterclockwise with respect to the first and fifth flighting sections.

42. A high density, single pass heat exchanger as set forth in claim 41, wherein at least a part of the eighth section of flighting from the inlet end of the drum is rotated about 75° counterclockwise with respect to the first and fifth flighting sections.

43. A high density, single pass heat exchanger as set forth in claim 42, wherein a ninth section of flighting from the inlet end of the drum has sheet members which are aligned with the sheet members of the first and fifth flighting sections.

44. In a high density, single pass heat exchanger for drying an alfalfa product having leaves which dry at one rate and stems which dry at a different rate and wherein the dryer includes an elongated, generally horizontal, hollow drum heat exchanger having an inlet and an outlet, means for creating a flow of heated gases through the drum from the inlet to the outlet thereof, and means for rotating the drum about its longitudinal axis, the combination with said drum of a stem dryer comprising:

tubular structure having a generally cylindrical main body located adjacent the outlet end of the drum and communicating with the interior of said drum, said structure including at least a pair of generally annular, circumferentially extending, axially spaced rings projecting inwardly from the inner face of the cylindrical body, at least one annular heat transfer fin member projecting inwardly from the inner face of the cylindrical body between said rings, spaced axially along the length of the body, and cooperating with adjacent rings or proximal members to define respective annular heat exchange chambers between said rings, each heat transfer fin member being provided with radially oriented notch means therein extending outwardly from the innermost margin of the fin member for allowing alfalfa leaves and stems to pass from one chamber to an adjacent chamber in a direction toward the outlet of the dryer.

45. A high density, single pass heat exchanger as set forth in claim 44, wherein the notch means in each heat transfer fin member is generally V-shaped.

46. A high density, single pass heat exchanger as set forth in claim 45, wherein the ring closest to the outlet of the tubular structure defines an annular outlet wall, said outlet wall being provided with a radially oriented notch therein which extends outwardly from the innermost margin of said outlet wall.

47. A high density, single pass heat exchanger as set forth in claim 46, wherein the notches in said outlet wall and the fin members are spaced from one another circumferentially of the structure to avoid alignment thereof axially of the drum.

48. A high density, single pass heat exchanger as set forth in claim 47, wherein is provided an innermost, unnotched annular ring, an intermediate unnotched annular ring spaced axially of the innermost ring, and outer, outlet defining ring spaced axially of the intermediate ring, said rings cooperating to define a respective annular chamber between adjacent rings.

49. A high density, single pass heat exchanger as set forth in claim 48, wherein is provided at least one annular fin between each pair of adjacent rings, the inner margins of the rings sequentially decreasing in diameter from the innermost ring to the outermost ring proximal to the outlet of the tubular structure.

50. A high density, single pass heat exchanger as set forth in claim 49, wherein said fin members and the outer ring proximal to the outlet of the tubular structure have a plurality of circumferentially spaced, V-shaped notches therein extending outwardly from the innermost margin of a fin member and ring respectively.

* * * * *